US010573202B2

(12) United States Patent
Warmus et al.

(10) Patent No.: US 10,573,202 B2
(45) Date of Patent: Feb. 25, 2020

(54) SELF-ERECTABLE DISPLAY WITH FREE FLOATING STOP AND METHOD FOR FORMING THE SAME

(71) Applicant: R. R. Donnelley & Sons Company, Chicago, IL (US)

(72) Inventors: James Warmus, La Grange, IL (US); Douglas R. Cwidak, Arlington Heights, IL (US); Robert B. Lipscomb, Plainfield, IL (US); Todd Alan Arnett, Joliet, IL (US); Marcellino Santoro, Jr., Bartlett, IL (US); William David Collings, Wheaton, IL (US)

(73) Assignee: R.R. Donnelley & Sons Company, Chicago, IL (US)

( * ) Notice: Subject to any disclaimer, the term of this patent is extended or adjusted under 35 U.S.C. 154(b) by 219 days.

(21) Appl. No.: 15/261,191

(22) Filed: Sep. 9, 2016

(65) Prior Publication Data

US 2018/0075788 A1 Mar. 15, 2018

(51) Int. Cl.
*G09G 1/06* (2006.01)
*G09F 1/06* (2006.01)

(52) U.S. Cl.
CPC ..... *G09F 1/065* (2013.01)

(58) Field of Classification Search
None
See application file for complete search history.

(56) References Cited

U.S. PATENT DOCUMENTS 822,841 A 6/1906 Hill
956,916 A 5/1910 Wiederseim, Jr.
(Continued)

FOREIGN PATENT DOCUMENTS

CN 1387175 A 12/2002
CN 101473360 7/2009
(Continued)

OTHER PUBLICATIONS

International Searching Authority, "International Search Report," issued in connection with PCT Patent Application No. PCT/US2017/045471, dated Oct. 18, 2017, 5 pages.
(Continued)

*Primary Examiner* — Kevin M Bernatz
(74) *Attorney, Agent, or Firm* — Hanley, Flight & Zimmerman, LLC

(57) ABSTRACT

A display apparatus includes a shroud having a first substrate and a second substrate disposed in opposition to one another, the first substrate and the second substrate being connected to one another at a first side by a first joint and at a second side by a second joint. A free-floating stop member is disposed in a volume of the shroud between the first and second substrates and between the first and second joints, the free-floating stop member including a channel extending along the free-floating stop member for at least a portion of a length of the free-floating stop member. An elastic member couples the first joint to the second joint to exert a tensile force therebetween and passes through the channel of the free-floating stop member. The free-floating stop member is translatable vertically within the shroud between a first position and a second position and the free-floating stop member is dimensioned to stop inward travel of the first joint and the second joint responsive to the tensile force exerted by the elastic member.

17 Claims, 17 Drawing Sheets

(56) References Cited

U.S. PATENT DOCUMENTS 1,028,147 A 6/1912 Stranders
1,545,771 A 7/1925 Hout
1,576,672 A 3/1926 Miller
1,656,341 A 1/1928 Smith
1,670,464 A 5/1928 Marsh
1,687,616 A 10/1928 Huye
1,902,566 A 3/1933 Marsh
2,108,349 A 2/1938 Rasmussen
2,113,288 A 4/1938 Berger
2,142,826 A 1/1939 Rosello
2,153,460 A 4/1939 Giles
2,210,317 A 8/1940 Dueringer
2,283,406 A 5/1942 Bacon
2,290,144 A 7/1942 Katz
2,404,089 A 7/1946 Pollock
2,601,374 A 6/1952 Ditzler et al.
2,637,924 A 5/1953 Hutt
2,728,461 A 12/1955 Paige
2,773,324 A 12/1956 Drueck, Jr.
2,833,074 A 5/1958 Jannes
2,892,276 A 6/1959 Nelson
2,918,178 A 12/1959 Leone
2,984,920 A 5/1961 Acosta et al.
3,015,898 A 1/1962 Keeslar
3,091,877 A 6/1963 Luchsinger
3,234,682 A 2/1966 Frankl
3,267,597 A 8/1966 Jannes
3,302,321 A 2/1967 Walker
3,571,958 A 3/1971 Stevens et al.
3,665,669 A 5/1972 Huber
3,666,607 A 5/1972 Weissman
4,234,148 A 11/1980 Maddestra et al.
4,610,363 A 9/1986 Flum et al.
4,619,426 A 10/1986 Drueck, Jr.
4,750,283 A 6/1988 Halpern
4,770,379 A 9/1988 Estvold
4,773,622 A 9/1988 Herlin
4,774,780 A 10/1988 Crowell
4,790,714 A 12/1988 Schnapp
4,854,060 A 8/1989 Corbo et al.
4,940,199 A 7/1990 Hall
4,984,848 A 1/1991 Scalisi et al.
4,993,846 A 2/1991 Diamond et al.
5,000,717 A 3/1991 Pfeiffer
5,090,349 A 2/1992 Wilson
5,193,466 A 3/1993 Eder
5,197,631 A 3/1993 Mishima
5,297,677 A 3/1994 Burian et al.
5,416,997 A 5/1995 Dyment et al.
5,454,180 A 10/1995 Volpe
5,467,547 A 11/1995 Fortner
5,632,390 A 5/1997 Podergois
5,752,649 A 5/1998 Weder
5,758,438 A 6/1998 Crowell
5,778,959 A * 7/1998 Guetschow ..... G09F 15/0068 160/135
5,787,621 A 8/1998 Leksell
5,809,673 A 9/1998 Johnson et al.
5,868,367 A 2/1999 Smith
5,878,945 A 3/1999 Weder
5,937,553 A 8/1999 Maran
5,966,857 A 10/1999 Pettersson et al.
5,983,538 A 11/1999 Crowell
6,311,418 B1 11/2001 Crowell
6,347,772 B1 2/2002 L'Hôtel
6,497,601 B1 12/2002 Ward
7,134,230 B1 11/2006 Boens et al.
7,159,350 B2 1/2007 L'Hotel
7,234,253 B2 6/2007 Ossmann
7,437,842 B2 10/2008 Sgambellone
7,634,865 B2 12/2009 L'Hôtel
7,726,054 B2 6/2010 Mestres Armengol et al.
7,774,964 B2 * 8/2010 L'Hotel ..... G09F 1/065 40/539
7,980,013 B2 7/2011 Hsu
7,980,016 B2 7/2011 L'Hotel
8,099,883 B2 1/2012 Mestres Armengol et al.
8,112,925 B2 2/2012 Tzuo
8,291,631 B2 10/2012 Wilder
8,458,939 B2 6/2013 Arthur et al.
8,590,188 B2 11/2013 Mirsch
8,701,321 B2 4/2014 Da Fonseca et al.
8,776,415 B2 * 7/2014 Kawaguchi ..... G09F 1/06 40/610
8,826,833 B1 9/2014 Fischer et al.
8,863,418 B2 10/2014 Acker et al.
8,875,908 B2 11/2014 L'Hotel
9,123,262 B1 9/2015 Frost
9,173,485 B2 11/2015 Fischer et al.
9,715,840 B1 * 7/2017 Warmus ..... G09F 1/065
9,734,734 B2 * 8/2017 Lyon ..... G09F 1/065
9,751,840 B2 * 9/2017 Choi ..... A61K 9/0019
9,779,640 B2 * 10/2017 Ruhaak ..... G09F 1/065
9,812,038 B2 * 11/2017 Lyon ..... G09F 1/065
9,978,292 B2 * 5/2018 Santoro, Jr. ..... G09F 1/065
10,008,138 B2 * 6/2018 Bonifas ..... G09F 15/0062
10,170,020 B2 * 1/2019 Cwidak ..... G09F 1/065
10,210,779 B2 2/2019 Enriquez
10,223,939 B2 * 3/2019 Warmus ..... G09F 1/065
2004/0111930 A1 6/2004 Ossmann
2006/0260165 A1 11/2006 Chenel
2007/0245610 A1 10/2007 Mestres Armengol et al.
2007/0294925 A1 12/2007 L'Hotel
2008/0066353 A1 3/2008 Mills
2008/0083146 A1 4/2008 Martin Presa
2010/0043261 A1 2/2010 Arthur et al.
2010/0072330 A1 * 3/2010 Tzuo ..... A47B 43/02 248/174
2010/0236117 A1 9/2010 Mestres Armengol et al.
2011/0088300 A1 4/2011 Martin Presa
2011/0179685 A1 7/2011 Mirsch
2012/0012734 A1 1/2012 Tzuo
2012/0227297 A1 * 9/2012 Kawaguchi ..... G09F 1/06 40/610
2013/0192110 A1 8/2013 Da Fonseca et al.
2013/0219760 A1 8/2013 Acker et al.
2014/0205772 A1 7/2014 Sitton
2014/0265777 A1 9/2014 Fischer et al.
2015/0265070 A1 9/2015 Mestres Armengol et al.
2016/0335925 A1 11/2016 Ruhaak
2016/0335934 A1 11/2016 Lyon
2016/0335935 A1 11/2016 Lyon
2017/0193866 A1 7/2017 Bonifas
2017/0213485 A1 7/2017 Santoro, Jr.
2017/0249874 A1 * 8/2017 Lopez Fernandez ... G09F 1/065
2017/0294149 A1 10/2017 Lyon
2018/0040262 A1 2/2018 Lyon
2018/0075781 A1 3/2018 Cwidak et al.
2018/0122272 A1 5/2018 Warmus
2018/0211571 A1 7/2018 Enriquez
2018/0268748 A1 9/2018 Enriquez
2019/0066550 A1 2/2019 Enriquez
2019/0279534 A1 9/2019 Lyon

FOREIGN PATENT DOCUMENTS

CN 102005160 4/2011
CN 202711641 U 1/2013
CN 203192354 9/2013
CN 204257165 4/2015
CN 205722637 11/2016
CN 101061527 10/2017
DE 2658506 1/1978
DE 4005925 10/1991
DE 4314654 11/1994
DE 9320993 8/1995
DE 202010015312 1/2011
DE 202011002980 4/2011
DE 202014106297 3/2015
DK 9500055 5/1995
DK 9500277 9/1995
EP 1741368 1/2007
EP 1830334 9/2007
EP 1926076 5/2008

(56) References Cited

FOREIGN PATENT DOCUMENTS

| | | |
|---|---|---|
| EP | 2290637 | 3/2011 |
| EP | 2400477 | 12/2011 |
| ES | 2212927 | 8/2004 |
| ES | 2255857 | 7/2006 |
| FR | 1254983 | 3/1961 |
| FR | 2210317 | 7/1974 |
| FR | 2232259 | 12/1974 |
| FR | 2233912 | 1/1975 |
| FR | 2571949 | 4/1986 |
| FR | 2574968 | 6/1986 |
| FR | 2650907 | 2/1991 |
| FR | 2680030 | 2/1993 |
| FR | 2691621 | 12/1993 |
| FR | 2730148 | 8/1996 |
| FR | 2735264 | 12/1996 |
| FR | 2745109 | 8/1997 |
| FR | 2760801 | 9/1998 |
| FR | 2760802 | 9/1998 |
| FR | 2760880 | 9/1998 |
| FR | 2770320 | 4/1999 |
| FR | 2911425 | 7/2008 |
| FR | 2925203 | 6/2009 |
| FR | 2925204 | 6/2009 |
| FR | 2929035 | 9/2009 |
| FR | 2948222 | 1/2011 |
| GB | 463574 | 4/1937 |
| GB | 740577 | 11/1955 |
| GB | 743378 | 1/1956 |
| GB | 824004 | 11/1959 |
| GB | 1034280 | 6/1966 |
| GB | 1272187 | 4/1972 |
| GB | 1317155 | 5/1973 |
| JP | 2003530602 | 10/2003 |
| WO | 9634379 | 10/1996 |
| WO | 9936900 | 7/1999 |
| WO | 2002095719 | 11/2002 |
| WO | 2004044867 | 5/2004 |
| WO | 2006040438 | 4/2006 |
| WO | 2006067252 | 6/2006 |
| WO | 2007138083 | 12/2007 |
| WO | 2008049176 | 5/2008 |
| WO | 2008125703 | 10/2008 |
| WO | 2010019086 | 2/2010 |
| WO | 2010130485 | 11/2010 |
| WO | 2011092209 | 8/2011 |
| WO | 2011113123 | 9/2011 |
| WO | 2012061375 | 5/2012 |
| WO | 2012164114 | 12/2012 |
| WO | 2016057067 | 4/2016 |
| WO | 2016071868 | 5/2016 |
| WO | 2017116605 A1 | 7/2017 |

OTHER PUBLICATIONS

International Searching Authority, "Written Opinion," issued in connection with PCT Patent Application No. PCT/US2017/045471, dated Oct. 18, 2017, 6 pages.

United States Patent and Trademark Office, "Non-Final Office Action," issued in connection with U.S. Appl. No. 14/709,266, dated May 23, 2016, 32 pages.

United States Patent and Trademark Office, "Notice of Allowance," issued in connection with U.S. Appl. No. 14/709,266, dated Sep. 26, 2016, 31 pages.

United States Patent and Trademark Office, "Non-Final Office Action," issued in connection with U.S. Appl. No. 14/709,285, dated Sep. 15, 2016, 38 pages.

United States Patent and Trademark Office, "Non-Final Office Action," issued in connection with U.S. Appl. No. 14/711,739, dated Sep. 16, 2016, 91 pages.

United States Patent and Trademark Office, "Non-Final Office Action," issued in connection with U.S. Appl. No. 15/229,920, dated Dec. 1, 2016, 9 pages.

International Searching Authority, "International Search Report and Written Opinion", issued in connection with PCT Application No. PCT/US2016/064478, dated Jan. 24, 2017, 15 pages.

United States Patent and Trademark Office, "Non-Final Office action", issued in connection with U.S. Appl. No. 15/786,405, dated Oct. 2, 2018, 31 pages.

United States Patent and Trademark Office, "Final Office Action," issued in connection with U.S. Appl. No. 14/709,285, dated Mar. 15, 2017, 24 pages.

United States Patent and Trademark Office, "Final Office Action," issued in connection with U.S. Appl. No. 14/711,739, dated Mar. 21, 2017, 19 pages.

United States Patent and Trademark Office, "Non-Final Office Action," issued in connection with U.S. Appl. No. 14/988,616, dated Apr. 11, 2017, 36 pages.

United States Patent and Trademark Office, "Notice of Allowance," issued in connection with U.S. Appl. No. 14/709,266, dated Apr. 12, 2017, 17 pages.

United States Patent and Trademark Office, "Notice of Allowance," issued in connection with U.S. Appl. No. 14/988,616, dated Feb. 28, 2018, 8 pages.

United States Patent and Trademark Office, "Notice of Allowance," issued in connection with U.S. Appl. No. 15/415,587, dated Jan. 19, 2018, 7 pages.

United States Patent and Trademark Office, "Non-Final Office action," issued in connection with U.S. Appl. No. 15/634,974, dated Apr. 9, 2018, 11 pages.

United States Patent and Trademark Office, "Final Office Action," issued in connection with U.S. Appl. No. 14/988,616, dated Oct. 30, 2017, 28 pages.

United States Patent and Trademark Office, "Notice of Allowance," issued in connection with U.S. Appl. No. 15/229,920, dated Mar. 22, 2017, 43 pages.

United States Patent and Trademark Office, "Office Action," issued in connection with U.S. Appl. No. 15/261,178, dated Sep. 29, 2017, 46 pages.

United States Patent and Trademark Office, "Notice of Allowance," issued in connection with U.S. Appl. No. 15/261,178, dated Aug. 3, 2018, 5 pages.

United States Patent and Trademark Office, "Notice of Allowance," issued in connection with U.S. Appl. No. 14/709,285, dated Jul. 3, 2017, 19 pages.

United States Patent and Trademark Office, "Non-Final Office Action," issued in connection with U.S. Appl. No. 15/415,587, dated Aug. 4, 2017, 40 pages.

United States Patent and Trademark Office, "Non Final Office Action," issued in connection with U.S. Appl. No. 15/690,031, daed Jun. 25, 2018, 8 pages.

United States Patent and Trademark Office, "Non Final Office Action," issued in connection with U.S. Appl. No. 16/201,535, dated Jan. 25, 2019, 13 pages.

United States Patent and Trademark Office, "Final Office Action," issued in connection with U.S. Appl. No. 15/690,031, dated Feb. 25, 2019, 9 pages.

United States Patent and Trademark Office, "Notice of Allowance," issued in connection with U.S. Appl. No. 15/786,405, dated Feb. 1, 2019, 9 pages.

United States Patent and Trademark Office, "Non Final Office Action," issued in connection with U.S. Appl. No. 15/786,405, dated Oct. 2, 2018, 8 pages.

United States Patent and Trademark Office, "Final Office Action," issued in connection with U.S. Appl. No. 15/634,974, dated Oct. 25, 2018, 8 pages.

United States Patent and Trademark Office, "Advisory Action," issued in connection with U.S. Appl. No. 15/634,974, dated Jan. 4, 2019, 9 pages.

United States Patent and Trademark Office, "Non-Final Office Action," dated Apr. 5, 2018 in connection with U.S. Appl. No. 15/657,548, 17 pages.

United States Patent and Trademark Office, "Notice of Allowance," dated Oct. 23, 2018 in connection with U.S. Appl. No. 15/657,548, 8 pages.

(56) References Cited

OTHER PUBLICATIONS

United States Patent and Trademark Office, "Notice of Allowance," issued in connection with U.S. Appl. No. 14/711,739, dated Jun. 8, 2017, 9 pages.
United States Patent and Trademark Office, "Final Office Action," issued in connection with U.S. Appl. No. 15/261,178, dated Apr. 11, 2018, 12 pages.
United States Patent and Trademark Office, "Non-Final Office Action," dated Aug. 8, 2019 in connection with U.S. Appl. No. 16/201,535, 11 pages.
State Intellectual Property Office of the People's Republic of China, "First Office Action," dated May 24, 2019 in connection with Chinese Patent Application No. 201710340752.6, 25 pages.
State Intellectual Property Office of the People's Republic of China, "Notice of Allowance," dated Mar. 16, 2018 in connection with Chinese Patent Application No. 201720947684.5, 4 pages, full document and English translation provided.
United States Patent and Trademark Office, "Notice of Allowance," dated Sep. 21, 2018 in connection with U.S. Appl. No. 15/909,155, 8 pages.
United States Patent and Trademark Office, "Non-Final Office Action," dated Jun. 25, 2018 in connection with U.S. Appl. No. 15/690,031, 10 pages.
United States Patent and Trademark Office, "Non-Final Office Action," dated Feb. 25, 2019 in connection with U.S. Appl. No. 15/690,031, 9 pages.
United States Patent and Trademark Office, "Non-Final Office Action," dated Sep. 19, 2019 in connection with U.S. Appl. No. 15/415,594, 7 pages.
United States Patent and Trademark Office, "Non-Final Office Action," dated Oct. 2, 2019 in connection with U.S. Appl. No. 16/421,116, 8 pages.
United States Patent and Trademark Office, "Non-Final Office Action," dated Oct. 11, 2019 in connection with U.S. Appl. No. 15/690,031, 7 pages.
China National Intellectual Property Administration (CNIPA), "First Office Action," dated Oct. 24, 2019, in connection with Chinese Patent Application No. 201810209272.0, 13 pages (Full document and English translation).
China National Intellectual Property Administration (CNIPA), "Notice of Allowance," dated Nov. 12, 2019 in connection with Chinese Patent Application No. 201710340752.6, 7 pages (full document and English translation).

* cited by examiner

SELF-ERECTABLE DISPLAY WITH FREE FLOATING STOP AND METHOD FOR FORMING THE SAME

FIELD OF THE DISCLOSURE

This disclosure relates generally to displays and, more particularly, to self-erectable displays, methods of making such self-erectable displays, and mechanisms for maintaining such self-erectable displays in an erect state.

BACKGROUND

Displays may be used at a point of purchase to provide advertising or other information. Some of these displays have a tubular shape and include outwardly facing indicia.

BRIEF DESCRIPTION OF THE DRAWINGS

The figures are not to scale. Wherever possible, the same reference numbers will be used throughout the drawings and accompanying written description to refer to the same or like parts.

DETAILED DESCRIPTION

Figure 1:
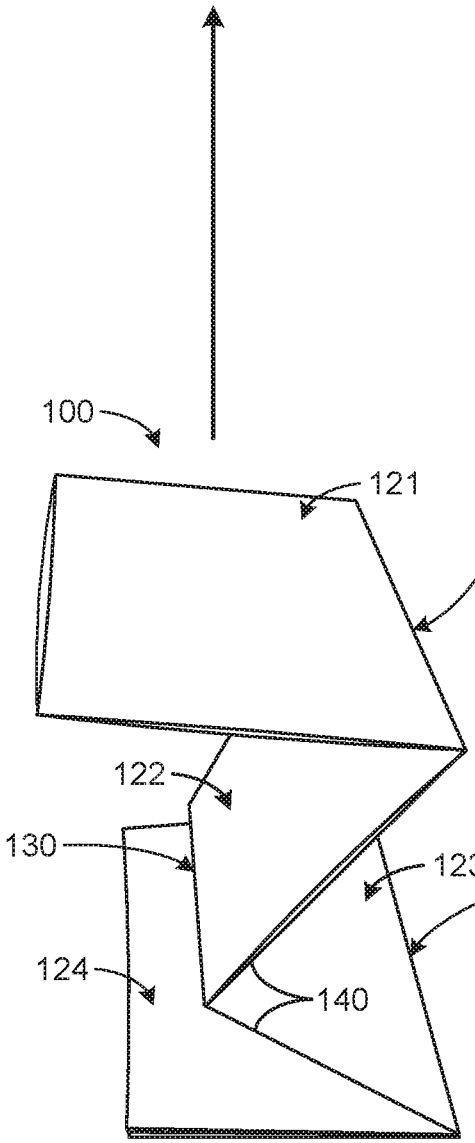
FIGS. 1-2 are perspective views of an example a pop-up display in accordance with teachings herein, showing the pop-up display transition from a folded state in FIG. 1 to an erected or deployed state in FIG. 2.

The examples disclosed herein relate to pop-up or self-erectable displays that can be used for point-of-sale advertising, providing information or for other suitable purposes. The example pop-up or self-erectable displays disclosed herein are configured to be collapsed to a folded, flat state, which facilitates shipping and transport, and to be readily erected at a location (e.g., a point-of-sale, a conference booth, a store, etc.) to effect a desired display function.

In some examples disclosed herein, the example self-erectable displays include one or more substrates (e.g., a sheet material, a panel, etc.) that, singly or in combination, form a tubular shroud into which one or more internal support structures are disposed or are able to be disposed. In some examples, the shroud defines a generally oblong cross-section having, along a longitudinal direction thereof (e.g., a height), a major axis dimension (e.g., a width) and a minor axis dimension (e.g., a depth). In other examples, the width and depth of the tubular shroud are equal (e.g., a substantially circular cross-section, etc.). A base structure is optionally attached to or integrated with one or more portions of the shroud, such as a base portion, to help to maintain the shroud in a desired orientation. While one particular example of an oblong cross-section is depicted herein, the present concepts include other manners of cross-sectional profile including, but not limited to, a triangular, square, diamond, circular, or other semi-circular, elliptical, polygonal shape, a polygon approximating a curvilinear shape (e.g., a heptagon, nonagon, or hendecagon approximating a circular shape, etc.) and/or non-polygonal shapes. By way of example, the substrates 120*a*, 120*b* of FIG. 2 or FIG. 3*a* could include one or more vertical lines of weakness to cause the final shape in the deployed state to be polygonal or, more particularly, a square shape or diamond shape, or a rhomboid shape, depending on placement of the lines of weakness.

In some examples, the example shroud is formed of an elongate substrate having top and bottom edges and first and second side edges. To enable the example pop-up or self-erectable display (hereinafter "display" or "self-erectable display") to be folded for transport or shipping and/or storage, in some examples, longitudinal and/or transverse lines of weakness 130 are defined by the shroud 120 (see, e.g., FIG. 2). These lines of weakness 130 enable the example self-erectable display 100 to be folded relatively flat, with adjacent segments of the shroud 120 being folding against one-another along the lines of weakness 130, such as in a multi-part z-fold, for example.

In some examples, as noted above, the shroud is formed from separate substrates that are coupled together to form a 3-D structure defining an interior volume. In some examples, the example free-floating former is formed of two substrates and one or more free-floating formers disposed therein. In some examples, the free-floating formers are generally planar. In yet further examples, the free-floating formers are generally planar and are further advantageously provided with a line of weakness to enable the free-floating formers to be folded relatively flat within the example shroud for transport, shipping and/or storage.

As is described herein, the self-erectable display is formed by (1) assembling one or more substrates together with one or more free-floating formers or (2) by unfurling a completed self-erectable display from a folded state.

Figure 2:
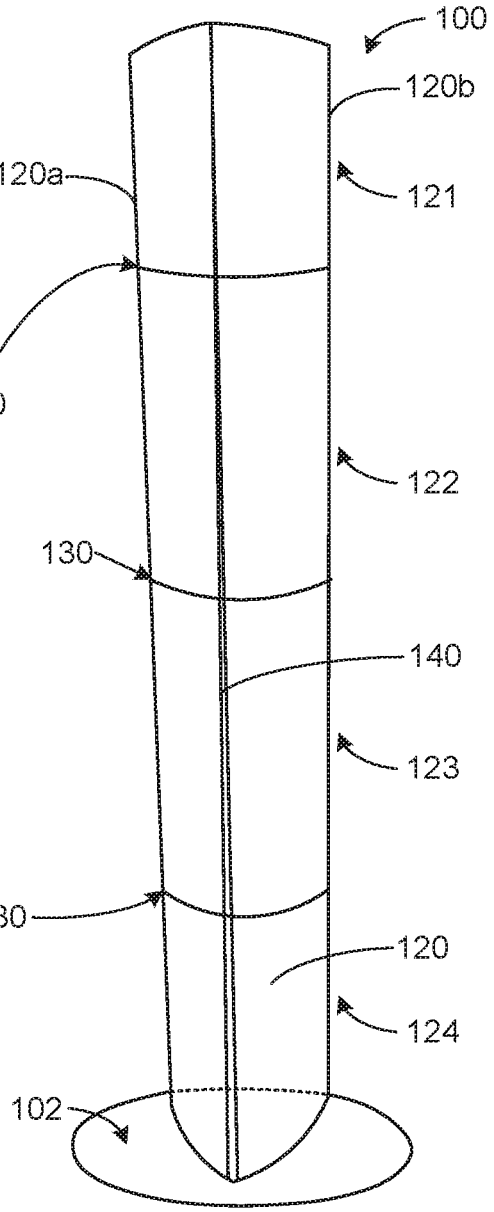

FIGS. 1-2 show an example of erecting a pop-up display 100, from a substantially flat initial state (not shown), to the depicted partially unfolded state (FIG. 1) and to the erected state (FIG. 2), in accordance with the teachings herein. In the example 4-segment segment pop-up display 100 depicted in FIGS. 1-2, the display is formed from substrates 120*a*, 120*b*, which are joined together to define a tubular structure or shroud 120.

The substrates 120*a*, 120*b* each include connection members at lateral portions thereof to permit connection of the substrates 120*a*, 120*b* to one other to form the shroud 120. In one example, each of the substrates 120*a*, 120*b* has, at lateral portions thereof, flaps 140*a*, 140*b* (see, e.g., FIG. 3) that are connected via one or more connecting elements (e.g., elastic members, snap connectors, clips, hook-and-eye fasteners, hook-and-loop fasteners (e.g., VELCRO® brand fasteners, etc.), pins, snap fasteners, string, twist ties, staples, etc.) to corresponding opposing flaps (e.g., connecting flap 140*a* of substrate 120*a* to flap 140*b* of substrate 120*b* and connecting flap 140*b* of substrate 120*a* to flap 140*a* of substrate 120*b*) to form joints 140. In other examples, the substrates 120*a*, 120*b* and/or the flaps 140*a*, 140*b* are connected by adhesives or thermal bonding at one or more points and, preferably, at one or more points per segment 121-124.

Each substrate 120*a*, 120*b* may comprise n segments, where n is any number including, but not limited to, 1 segment, 2 segments, 3 segments, 4 segments (as shown), or more than 4 segments. Where the substrates 120*a*, 120*b* 120 comprise a plurality of segments, each segment (e.g., segments 121-124 in FIGS. 1-2) is hinged to an adjacent segment by a line of weakness 130 formed in the substrates 120*a*, 120*b*. Each line of weakness 130 is formed in substantially the same position, along a height of the shroud 120, so that the lines of weakness 130 of substrate 120*a* are substantially aligned with the lines of weakness 130 of substrate 120*b* and the segments thereof fold as a unit. For example, the line of weakness 130 joining segment 121 of substrate 120*a* is vertically aligned with the line of weakness 130 joining segment 121 of substrate 120*b* so that, when substrates 120*a*, 120*b* are collapsed to a substantially flat state, both substrates 120*a*, 120*b* fold segment 121 about the line of weakness 130 relative to the underlying segment 122.

Figure 12:
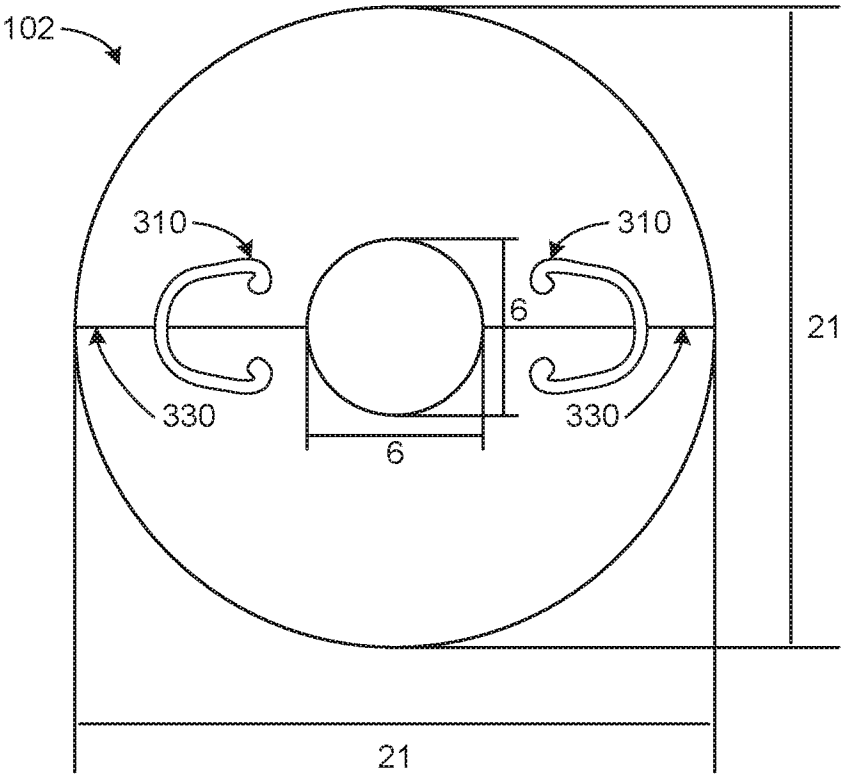
FIG. 12 shows an example foldable stand that is optionally integrated with the pop-up display in accordance with teachings herein.

In the example shown in FIG. 2, the pop-up display 100 is supported by an optional base member 102, an example of which is shown in FIG. 12. Alternatively, as the shroud 120 itself is entirely self-supporting, the base member 102 may be omitted.

In some examples, the pop-up display 100 is configured to automatically deploy (open fully) once the flat segments 121-124 from the stowed state have been unfolded or unfurled by rotating the segments 121-124 relative to another about the lines of weakness 130 to place the segments in a substantially vertical orientation. As discussed in more detail below, biasing forces of elastic members disposed internally within the volume of the shroud 120 are used to automatically constrict or collapse the free-floating stop members to draw joints 140 of the shroud 120 inwardly to thereby force central portions of the substrates 120*a*, 120*b* outwardly to yield the tubular form of shroud 120. In other examples, additional elastic members are optionally disposed between adjacent segments (e.g., connecting segment 121 to segment 122, etc.) to provide additional biasing forces about the lines of weakness or joints between such adjacent segments to assist the unfolding or unfurling of the folded pop-up display 100.

The example pop-up display 100 shown in FIG. 2 can be collapsed, folded and stowed by pressing the sides of the display 100 along center portions of the faces of the substrates 120*a*, 120*b* (e.g., left-to-right inward force applied to the left substrate 120*a* in FIG. 2 and right-to-left inward force applied to right substrate 120*b* in FIG. 2, etc.) to counter the bias of the elastic members and to inwardly deform the curvilinear aspect of the erected substrates 120*a*, 120*b*. This deformation of the curvilinear aspect of the erected substrates 120*a*, 120*b*, causes expansion of the elastic members in the shroud 120 and expansion of the internal support structures in the shroud, as discussed below, until each segment (e.g., 121-123 in a three-segment display) attains a flattened state. Each flattened segment may then be rotated about the line of weakness 130 of an adjoining segment to fold the shroud 120.

Figure 3A:
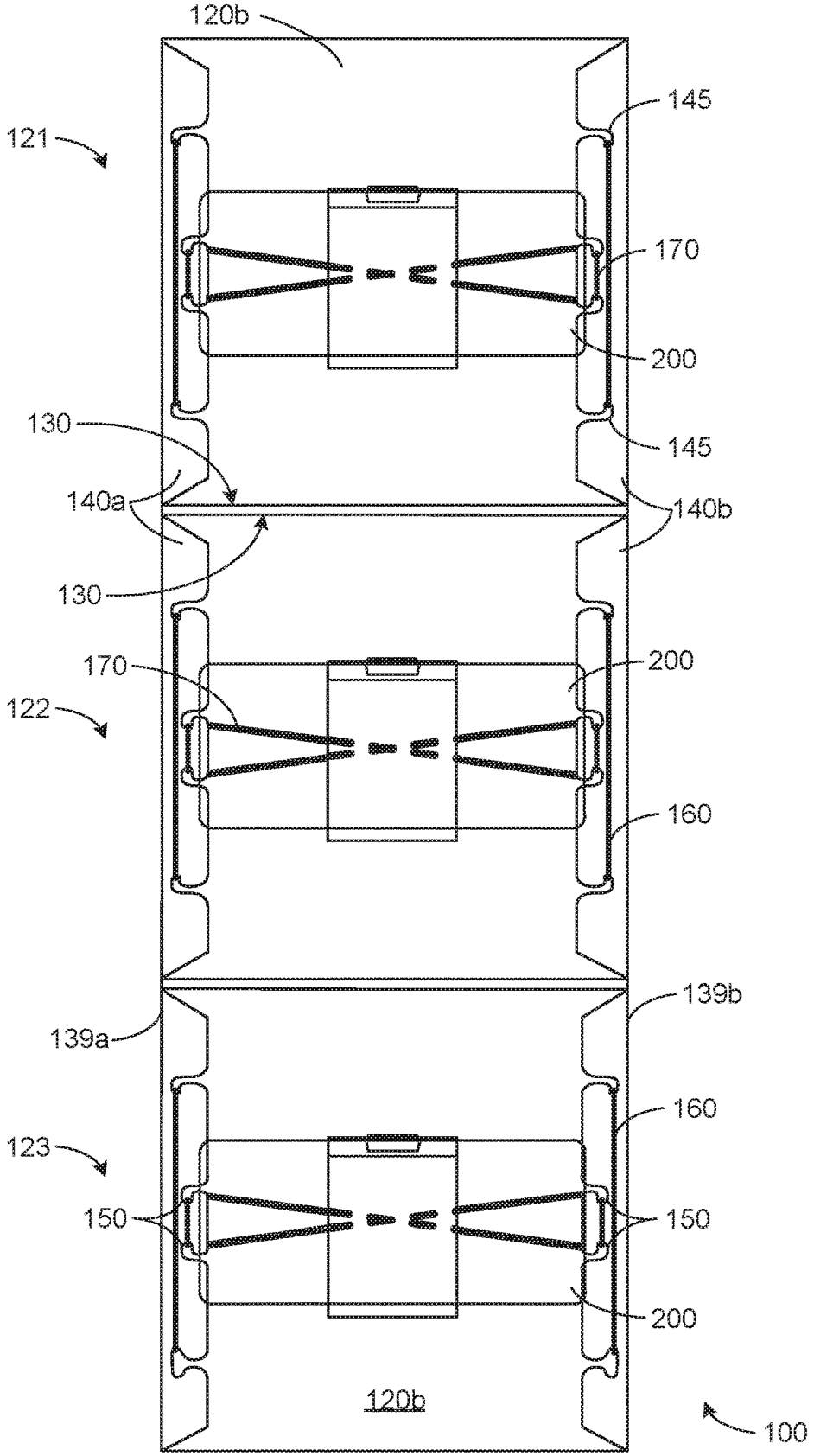
FIG. 3*a* is a cross-sectional side view of a deployed pop-up display in accordance with teachings herein.
Figure 3B:
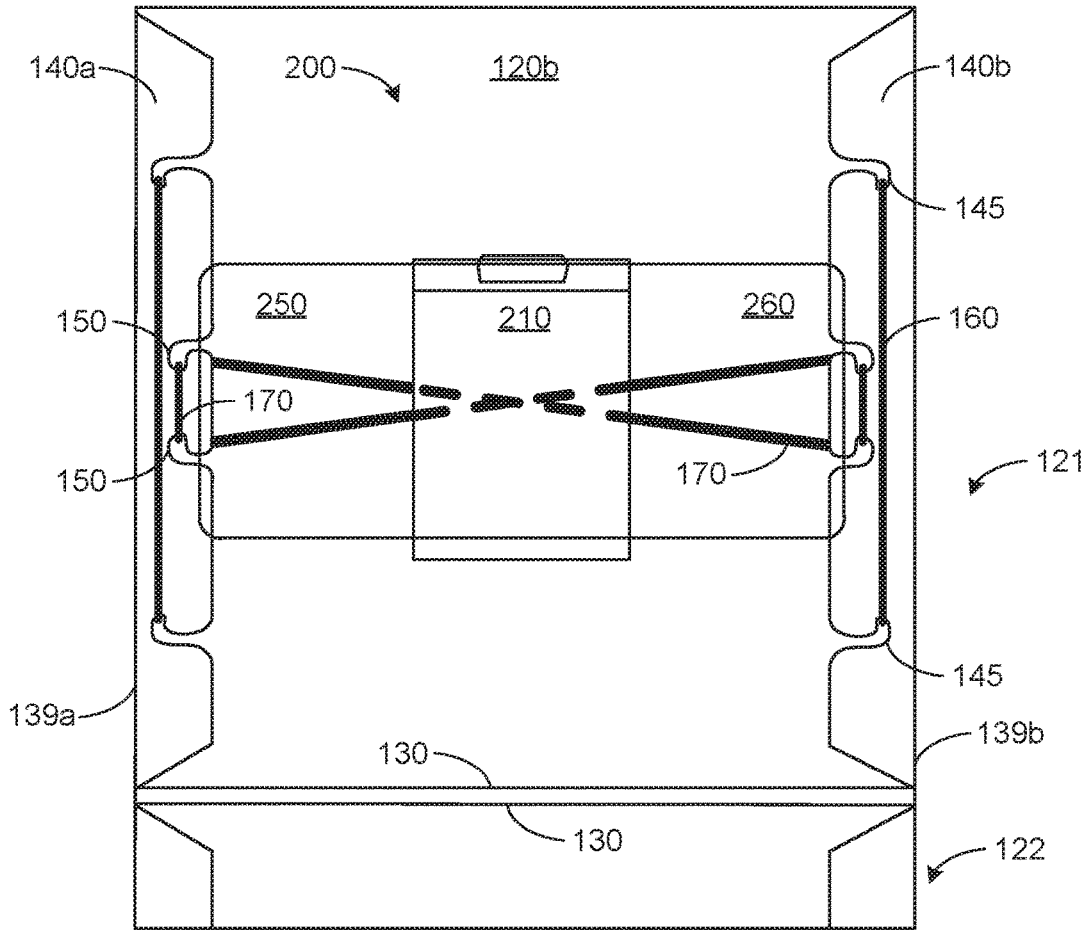
FIG. 3*b* is a cross-sectional side view of the pop-up display of FIG. 3*a* showing a free-floating stop member or free-floating former in accordance with teachings herein.

FIGS. 3*a*-3*b* are cross-sectional views of an example display 100 in accordance with teachings herein, with FIG. 3*b* being a close-up view of an internal volume of a top segment 121 of an example three-segment pop-up display 100 in accordance with teachings disclosed herein. The front substrate 120*a* of FIGS. 3*a*-3*b* is removed to show the interior of the pop-up display 100 and the rear substrate 120*b*. Substrate 120*b* includes, at lateral ends, flaps 140*a*, 140*b* that fold inwardly, along respective lines weakness 139*a*, 139*b*, to project into an interior volume of the assembled pop-up display 100 (see, e.g., FIG. 8). Each of the flaps 140*a*, 140*b* defines a variety of features including example grooves 145 and example grooves 150, described below. These features are also correspondingly provided in the opposing substrate 120*a* (removed for clarity in FIGS. 3*a*-3*b*).

Each set of example top and bottom grooves 145 in each example flap 140*a*, 140*b* of substrates 120*a*, 120*b* retains an example elastic member 160 that is used to connect example substrates 120*a*, 120*b* together. When substrate 120*b* is assembled together with substrate 120*a*, the elastic member 160 is disposed about both the top and bottom grooves 145 in each flap 140 of substrate 120*b* and, correspondingly, top and bottom grooves 145 in substrate 120*a*. These flap 140 features enable the elastic member 160 to connect the substrates 120*a*, 120*b*. FIG. 3*b* shows these features for an example top segment 121 of the example three segment pop-up display 100 of FIG. 3*a*, with similar features being correspondingly included in substrate 120*a* (not shown in FIGS. 3*a*-3*b*). It is noted that, in the bottom segment 123 of the example pop-up display 100 in FIG. 3*a*, the lowermost groove 145 has a two-lobed configuration, as compared to the top groove 145 in segment 123 and the top and bottom grooves 145 in the segments 121-122 depicted in FIG. 3*a*. The extra lobe of the lowermost groove 145 represents fixation points to which attachment members (e.g., elastic members, etc.) from the stand 105 of FIG. 2 is able to be attached to secure the stand 105 to the shroud 120.

While the example display 100 uses top and bottom grooves 145 and elastic members 160 to connect example substrates 120*a*, 120*b* together, the substrates 120*a*, 120*b* may be connected to one another at one or more points along the flaps 140*a*, 140*b*, or joint formed thereby, using other conventional means of connection (e.g., an elastic band, an adhesives, tape, bonding, a snap connector, a twist tie, a slot and tab connector, a clamping element, a clip, a hook-and-eye fastener, a hook-and-loop fastener (e.g., VELCRO® brand fasteners), a pin, and/or string, in any number or combination).

The example grooves 150 are provided to receive and retain one or more elastic members 170 disposed to span the shroud 120 from an example first joint 140 formed by a first set of flaps 140*a*, 140*b* to an example second joint 140 formed by a second set of flaps 140*a*, 140*b*. As shown in FIGS. 3*a*-3*b*, a single elastic member 170 in the form of a band is disposed to span the shroud 120 from the first joint to the second joint, with one end of the elastic member 170 being rotated 180° relative to the other end, so as to cause the opposite side of the band to cross over one another in a middle portion of the elastic member. In another example, a first elastic member 170 is disposed to span the shroud 120 from a first groove 150 of a first joint 140 to a second groove 150 of a second joint 140 and a second elastic member 170 is disposed to span the shroud 120 from a second groove 150 of a first joint 140 to a first groove 150 of a second joint 140. In another example, the grooves 150 are replaced with slots or eyelets and the elastic members 170 include connection members (e.g., bars) at each end for connection through such slots or eyelets.

FIGS. 3*a*-3*b* also show example free-floating stop members 200 disposed in each of the segments 121-123 to extend between the first and second example joints 140 formed by the respective pairs of flaps 140*a*, 140*b*. FIG. 3*b* shows more particularly the configuration of the example free-floating stop member 200 of FIG. 3*a*, wherein the example free-floating stop member 200 is generally rectangular in shape. The first end portion 250 and second end portion 260, or proximal and distal end portions, respectively, abut against the first and second joints 140, respectively, and/or one of the substrates 120*a*, 120*b*. In the example of FIG. 3*b*, the example stop element 200 has disposed at a central region thereof, a retaining member 210 that interacts with the elastic member 170 to provide an upper limit and a lower limit to vertical movement of the free-floating stop member 200 relative to the elastic member 170. Stated differently, the free-floating stop member 200 is free-floating and is free to move upwardly or downwardly within the respective segment, with the upper and lower extents of such travel being limited by abutment of the elastic member 170 against the retaining member 210 providing an upper limit and a lower limit to vertical movement of the free-floating stop member 200 relative to the elastic member 170. For example, while the free-floating stop member 200 is shown "floating" in FIGS. 3*a* and 3*b*, gravity may pull the free-floating stop member 200 downwardly so the top of the retaining member 210 rests on the elastic band 170.

The elastic member 170 held by the grooves 150 biases the first and second example joints 140 formed by the respective pairs of flaps 140*a*, 140*b* toward one another until movement of the joints 140 is stopped by action of the free-floating stop member 200 disposed between the joints 140.

Figure 4A:
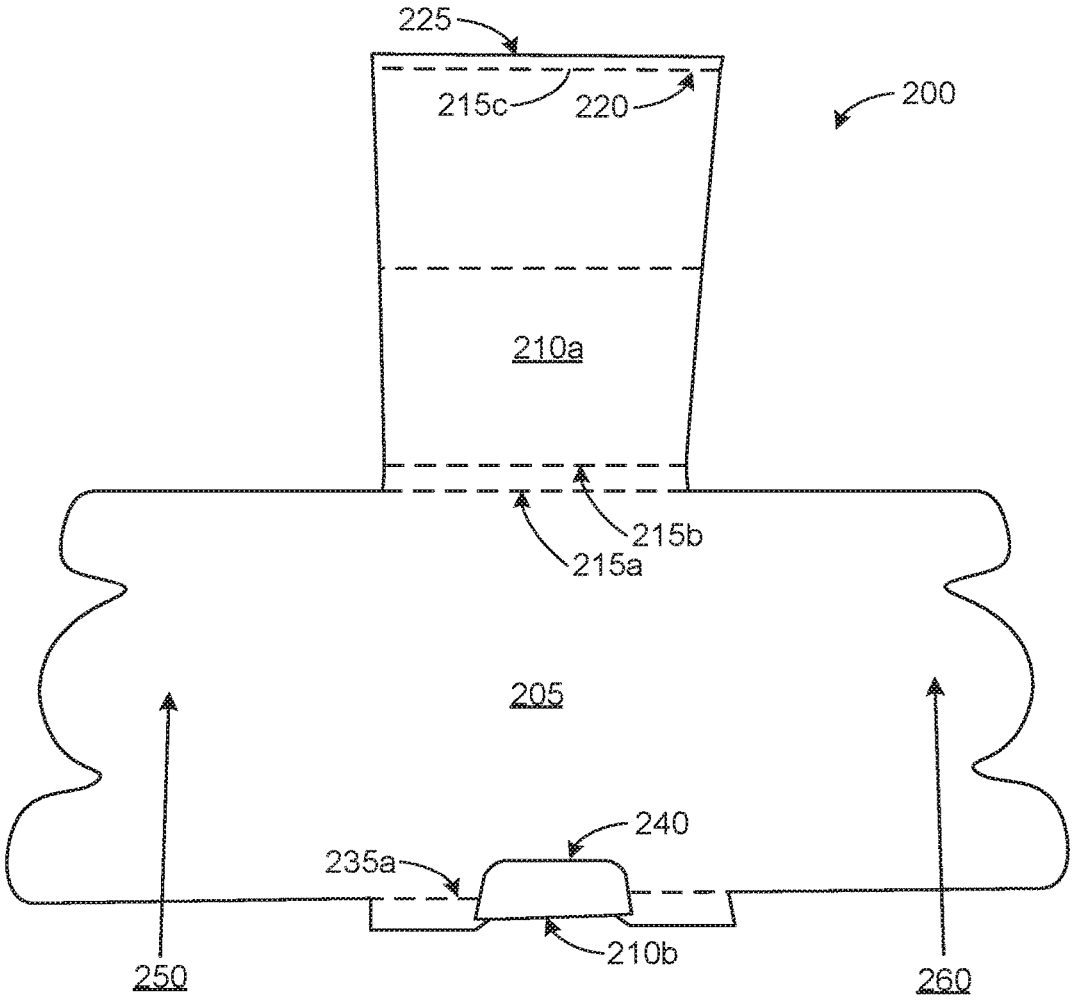
FIGS. 4*a*-4*b* are images of an example of a free-floating stop member or free-floating former represented in FIGS. 3*a*-3*b* in an open position and in a closed position, respectively, in accordance with teachings herein.
Figure 4B:
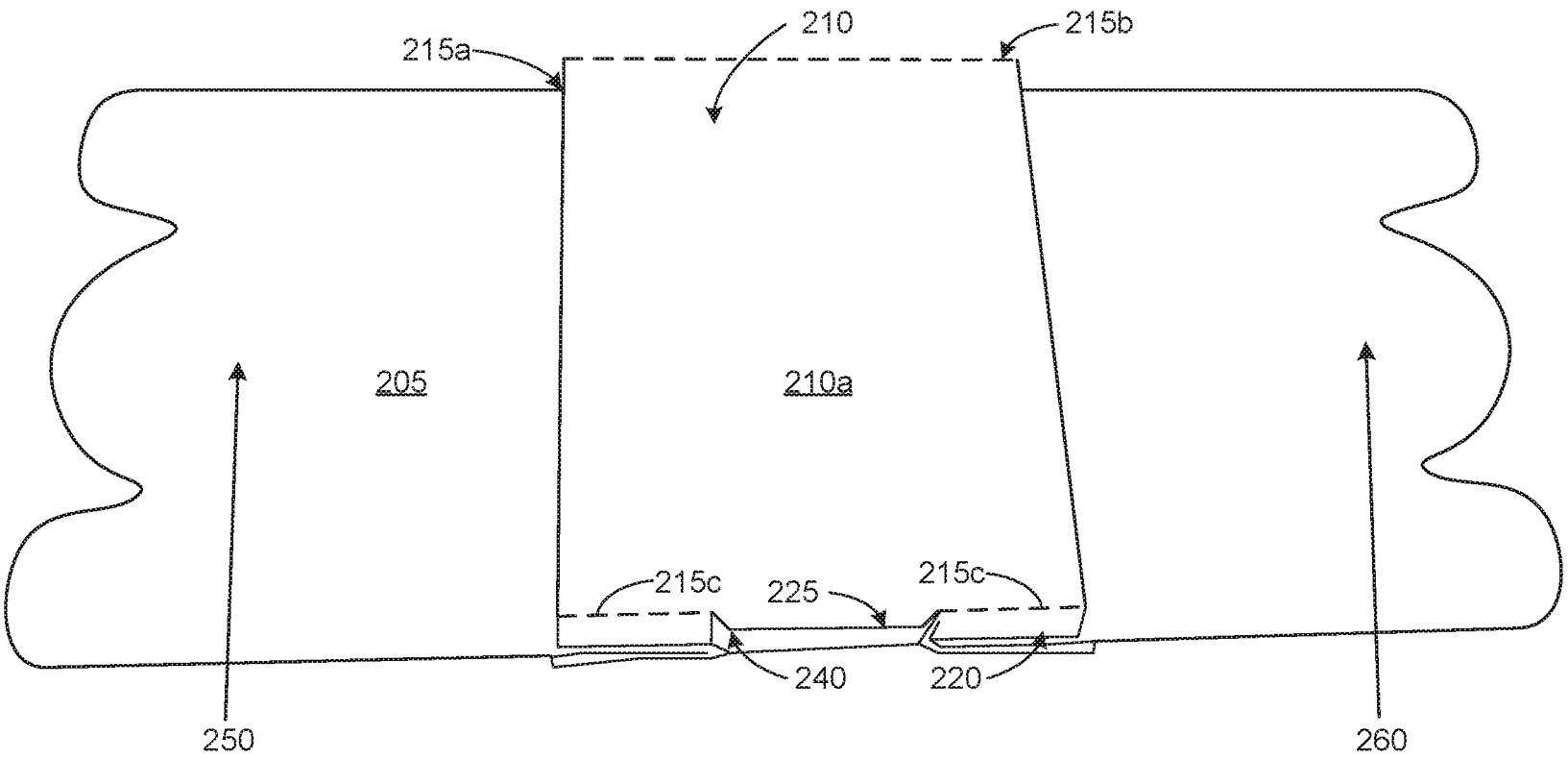
Figure 4C:
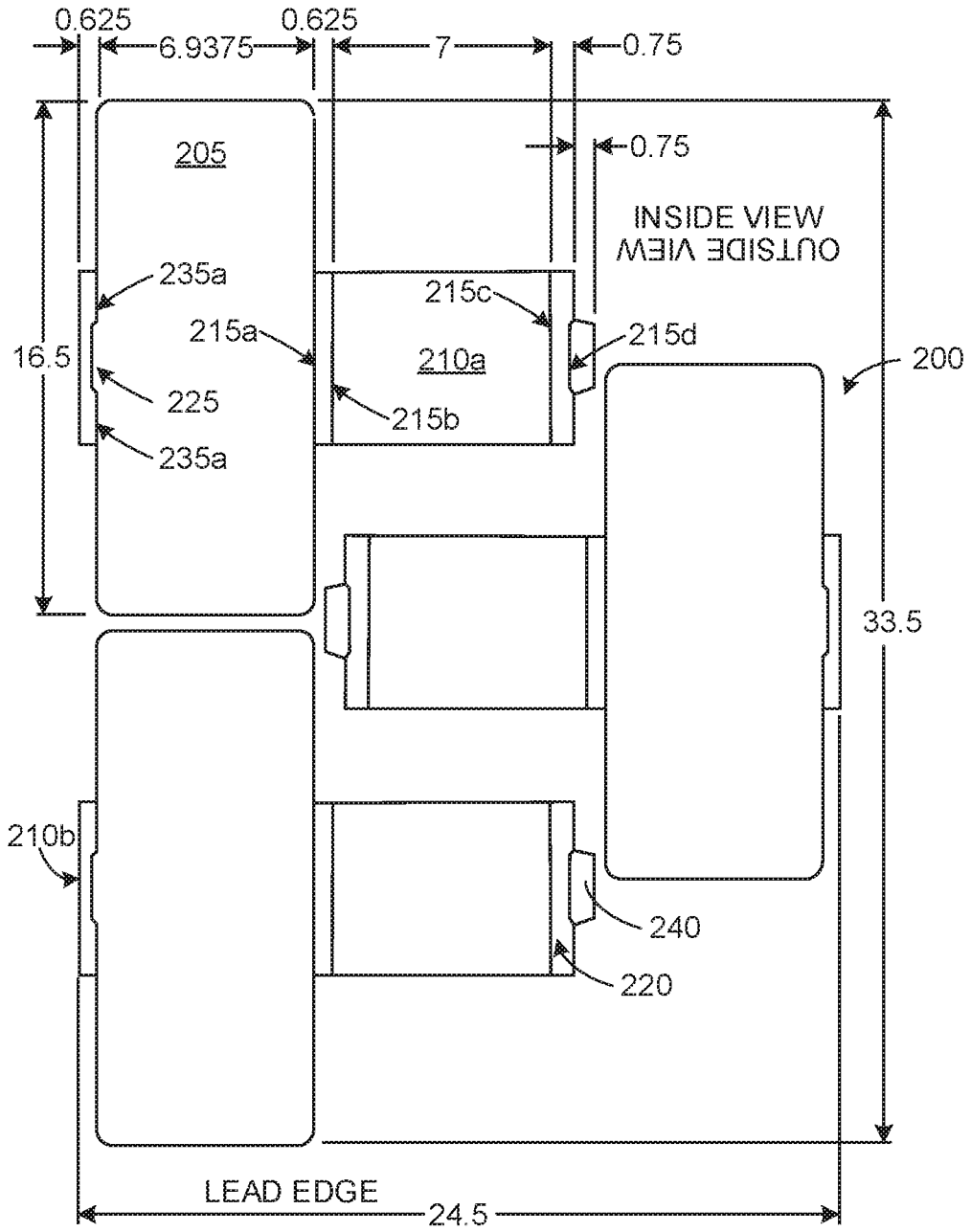
FIG. 4*c* is a schematic of a substrate material from which three free-floating stop members or free-floating formers from FIGS. 3*a*-3*b* may be formed, including example dimensions thereof in accordance with teachings herein.

An example of an example free-floating stop member 200 with an example retaining member 210 is shown in FIGS. 4*a*-4*c*. Although the retaining member 210 is shown to be an integral part of the free-floating stop member 200 in the example shown in FIGS. 4*a*-4*c*, in other examples in accordance with the teachings herein the retaining member 210 is a member separate from the free-floating stop member 200 and is attached to, or disposed around, the free-floating stop member during construction of the display 100. In the example free-floating stop member 200 of FIGS. 4*a*-4*c*, a base portion 205 of the free-floating stop member 200 has depending therefrom at an upper end or a first end an example first retaining member portion 210*a* and has depending therefrom at a lower end or a second end an example second retaining member portion 210*b*. The example first retaining member portion 210*a* and the example second retaining member portion 210*b* connect together, such as in shown in FIG. 3*b* and FIG. 4*b*, to define a channel through which the elastic member 170 passes.

More particularly, the example first retaining member portion 210*a* depends from the base portion 205 of free-floating stop member 200 via two adjacent lines of weakness 215*a*, 215*b*, or joints, that permit the example first retaining member portion 210*a* to rotate over the base portion 205 so as to be substantially parallel thereto, and set apart therefrom by a dimension corresponding to the distance between the two adjacent lines of weakness 215*a*, 215*b*. A distal portion of the example first retaining member portion 210*a* has depending therefrom, via a line of weakness or joint 215*c*, a flap 220 defining one or more slots 225. The flap 220 rotates 90° relative to the line of weakness or joint 215*c* to rotate the flap 90° relative to the example first retaining member portion 210*a*, which disposed the flap 220 so as to be substantially perpendicular to the base portion 205. In this position, in the example shown, the one or more slots 225 are then facing downwardly.

The example second retaining member portion 210*b* depends from the base portion 205 of free-floating stop member 200 via one line of weakness 235*a*, or joint, that permits the example second retaining member portion 210*b* to rotate 90° relative to the base portion 205 so as to be substantially perpendicular thereto. A distal portion of the example second retaining member portion 210*b* has depending therefrom, via a line of weakness or joint 235*b*, one or more tabs 240 corresponding in number and size to the one or more slots 225 defined in the flap 220 of the example first retaining member portion 210*a*. Each tab 240 rotates relative to the line of weakness or joint 235*b* by about 90°, relative to the base portion 205, so as to position the tab 240 substantially perpendicular to the base portion. In this position, in the example shown, the one or more tabs 240 are then facing upwardly to engage the corresponding one or more slots 225 of flap 220, such as is shown in the example of FIG. 4*b*. It is noted that the first end portion 250 and the second end portion 260 of the free-floating stop member 200 of FIGS. 4*a*-4*b* represent other example proximal and distal end portions in accord with the teachings herein.

FIG. 4*c* shows a schematic of a substrate (e.g., sheet material) from which three free-floating stop members or free-floating formers similar to those shown in FIGS. 3*a*-3*b* (or FIGS. 4*a*-4*b*) may be formed, including example dimensions thereof in accordance with teachings herein. As to an individual free-floating stop member 200 (upper left of FIG. 4*c*), there is shown a base portion 205 having depending therefrom at a first end an example first retaining member portion 210*a* and having depending therefrom at a second end an example second retaining member portion 210*b*. The example first retaining member portion 210*a* depends from the base portion 205 of free-floating stop member 200 via two adjacent lines of weakness 215*a*, 215*b*, or joints, that permit the example first retaining member portion 210*a* to rotate over the base portion 205 so as to be substantially parallel thereto, and set apart therefrom by a dimension corresponding to the distance between the two adjacent lines of weakness 215*a*, 215*b*. A distal portion of the example first retaining member portion 210*a* has depending therefrom, via a line of weakness or joint 215*c*, a flap 220 defining one tab 240, as shown. The tab 240, in turn, is connected to the flap 220 via a line of weakness or joint 215*d* permitting the tab 240 to rotate 90° relative to the flap 220. In this position, in the example shown, the one or more slots 225 are then facing downwardly.

The example second retaining member portion 210*b* depends from the base portion 205 of free-floating stop member 200 via one line of weakness or joint 235 that permits the example second retaining member portion 210*b* to rotate 90° relative to the base portion 205 so as to be substantially perpendicular thereto. In this example, a slot 225 is formed in the example second retaining member portion 210*b* in the region of the line of weakness or joint 235 between the base portion 205 and the example second retaining member portion 210*b*. The slot 225 corresponds in size and location to receive the tab 240 from the example first retaining member portion 210*a*. In the example of FIG. 4*c*, the depth of the example second retaining member portion 210*b* and the depth of the example first retaining member portion 210*a*, defined by the distance between the lines of weakness 215*a*, 215*b*, are substantially equal (e.g., ⅝"), but could be different from one another. A depth of the flap 220, relative to the line of weakness 215*d*, is slightly larger than the depth of the example second retaining member portion 210*b* (e.g., ¾"), and a width of the example first retaining member portion 210*a* (e.g., 7") being slightly greater than a width of the example second retaining member portion 210*b* (e.g., 6 15/16"), to facilitate engagement of the example first and second retaining member portions 210*a*, 210*b* and tab 240 and slot 225 thereof. A length of the example free-floating stop member 200 is shown to be 16½". These dimensions are, of course, examples, and these dimensions are freely varied to correspond to a particular shroud 120 configuration and size.

Figure 5:
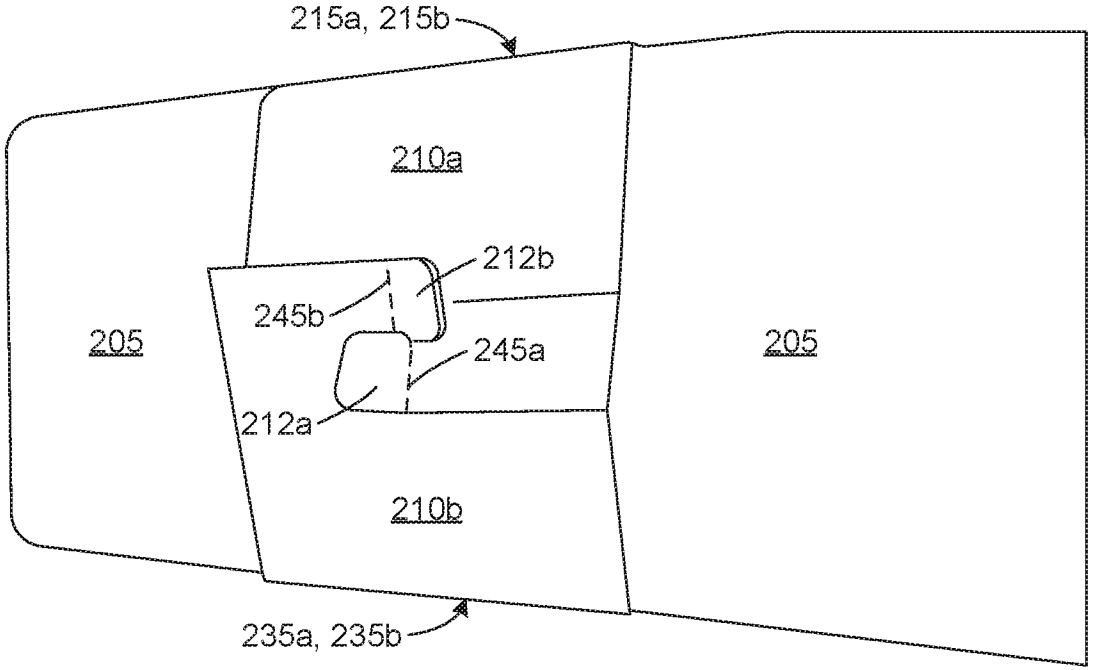
FIG. 5 is an image of another example of a free-floating stop member or free-floating former in accordance with teachings herein.

FIG. 5 shows another example of an example free-floating stop member 200 in accord with the teachings herein. A base portion 205 of the free-floating stop member 200 has depending therefrom at an upper end an example first retaining member portion 210*a* and has depending therefrom at a lower end an example second retaining member portion 210*b*. The example first retaining member portion 210*a* and the example second retaining member portion 210*b* connect together, such as in shown in FIG. 5, to define a channel through which the elastic member 170 passes. The example first retaining member portion 210*a* depends from the base portion 205 of free-floating stop member 200 via two adjacent lines of weakness 215*a*, 215*b*, or joints, similar to that shown in FIG. 4*c*, that permits the example first retaining member portion 210*a* to rotate over the base portion 205 so as to be substantially parallel thereto, and set apart therefrom by a dimension corresponding to the distance between the two adjacent lines of weakness 215*a*, 215*b*. Similarly, the example second retaining member portion 210*b* depends from the base portion 205 of free-floating stop member 200 via two adjacent lines of weakness 235*a*, 235*b* (similar to that of 215*a*, 215*b* shown in FIG. 4*c*), that permits the example second retaining member portion 210*b* to rotate over the base portion 205 so as to be substantially parallel thereto, and set apart therefrom by a dimension corresponding to the distance between the two adjacent lines of weakness 235*a*, 235*b*.

Distal portions of each of the example first and second retaining member portions 210*a*, 210*b* have depending therefrom, via line of weakness 245*a*, 245*b*, tabs 212*a* and 212*b*, respectively. These tabs 212*a*, 212*b* are rotated outwardly during assembly of the free-floating stop member 200 so that the example first retaining member portion 210*a* and the example second retaining member portion 210*b* can rotate past each other to a position wherein each is substantially parallel to the base portion 205. The tabs 212*a*, 212*b* are then rotated inwardly to lock the example first retaining member portion 210*a* to the example second retaining member portion 210*b*.

Figure 6:
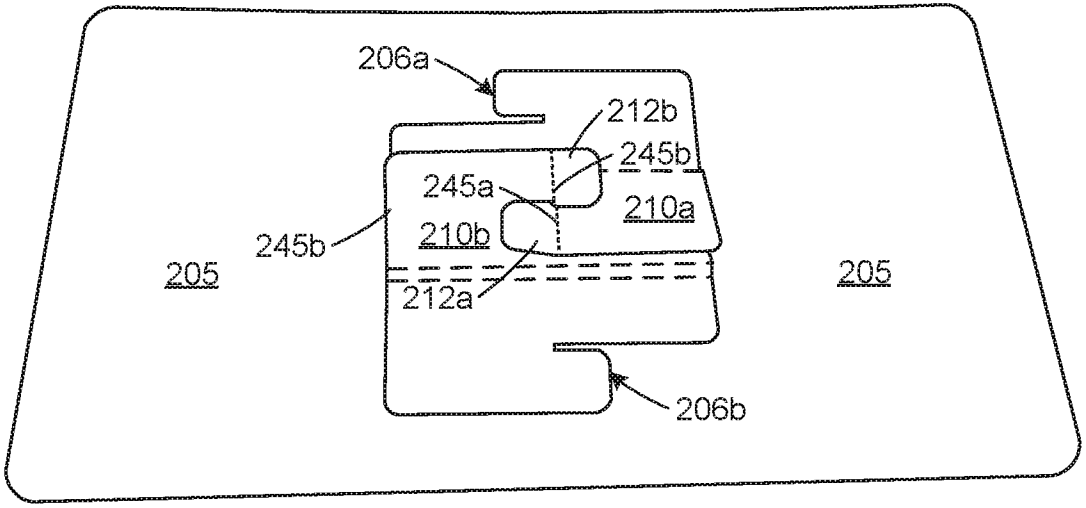
FIG. 6 is an image of yet another example of a free-floating stop member or free-floating former in accordance with teachings herein.

FIG. 6 shows yet another example of an example free-floating stop member 200 in accord with the teachings herein. A base portion 205 of the free-floating stop member 200 has a first partial cut out 206*a* defining an example first retaining member portion 210*a* and a second partial cut out 206*b* defining an example second retaining member portion 210*b*. The example first retaining member portion 210*a* and the example second retaining member portion 210*b* connect together, such as in shown in FIG. 6, to define a channel through which the elastic member 170 passes. The example first retaining member portion 210*a* depends from the base portion 205 of free-floating stop member 200 via two adjacent lines of weakness 215*a*, 215*b*, or joints, similar to that shown in FIG. 4*c*, that permits the example first retaining member portion 210*a* to rotate over the base portion 205 so as to be substantially parallel thereto, and set apart therefrom by a dimension corresponding to the distance between the two adjacent lines of weakness 215*a*, 215*b*. Similarly, the example second retaining member portion 210*b* depends from the base portion 205 of free-floating stop member 200 via two adjacent lines of weakness 235*a*, 235*b* (similar to that of 215*a*, 215*b* shown in FIG. 4*c*), that permits the example second retaining member portion 210*b* to rotate over the base portion 205 so as to be substantially parallel thereto, and set apart therefrom by a dimension corresponding to the distance between the two adjacent lines of weakness 235*a*, 235*b*.

Distal portions of each of the example first and second retaining member portions 210*a*, 210*b* have depending therefrom, via line of weakness 245*a*, 245*b*, tabs 212*a* and 212*b*, respectively. These tabs 212*a*, 212*b* are rotated outwardly during assembly of the free-floating stop member 200 so that the example first retaining member portion 210*a* and the example second retaining member portion 210*b* can rotate past each other to a position wherein each is substantially parallel to the base portion 205. The tabs 212*a*, 212*b* are then rotated inwardly to lock the example first retaining member portion 210*a* to the example second retaining member portion 210*b*.

Figure 7:
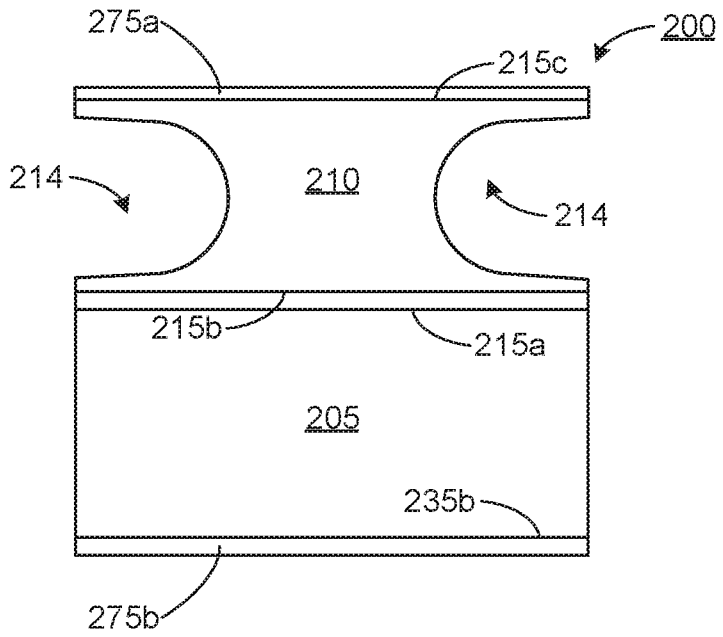
FIG. 7 is an image of still another example of a free-floating stop member or free-floating former in accordance with teachings herein.

FIG. 7 shows still another example of an example free-floating stop member 200 in accord with the teachings herein. In this example, the free-floating stop member 200 is a single piece of stock material having a base portion 205 and an example retaining member portion 210 separated by two adjacent lines of weakness 215*a*, 215*b*, or joints, similar to that shown in FIG. 4*c*, that permits the example retaining member portion 210 to rotate over the base portion 205 so as to be substantially parallel thereto. In the closed or folded position, the example retaining member portion 210 is set apart from the base portion 205 by a dimension corresponding to the distance between the two adjacent lines of weakness 215*a*, 215*b*. In this example, the retaining member portion 210 defines optional lateral openings 214. The optional lateral openings 214 facilitate manipulation of the elastic member 170 within the free-floating stop 200, such as during assembly, disassembly, or repair/maintenance (e.g., repositioning of a mispositioned elastic member, etc.). A distal portion of the example retaining member portion 210 defines a first flap 275*a* and a distal portion of the base portion 205 defines a second flap 275*b*. These flaps are connectable via, for example, an elastic band, an adhesives, tape, bonding, a snap connector, a twist tie, a slot and tab connector, a clamping element, a clip, a hook-and-eye fastener, a hook-and-loop fastener (e.g., VELCRO® brand fasteners), a pin, and/or string, in any number and combination.

Figure 8:
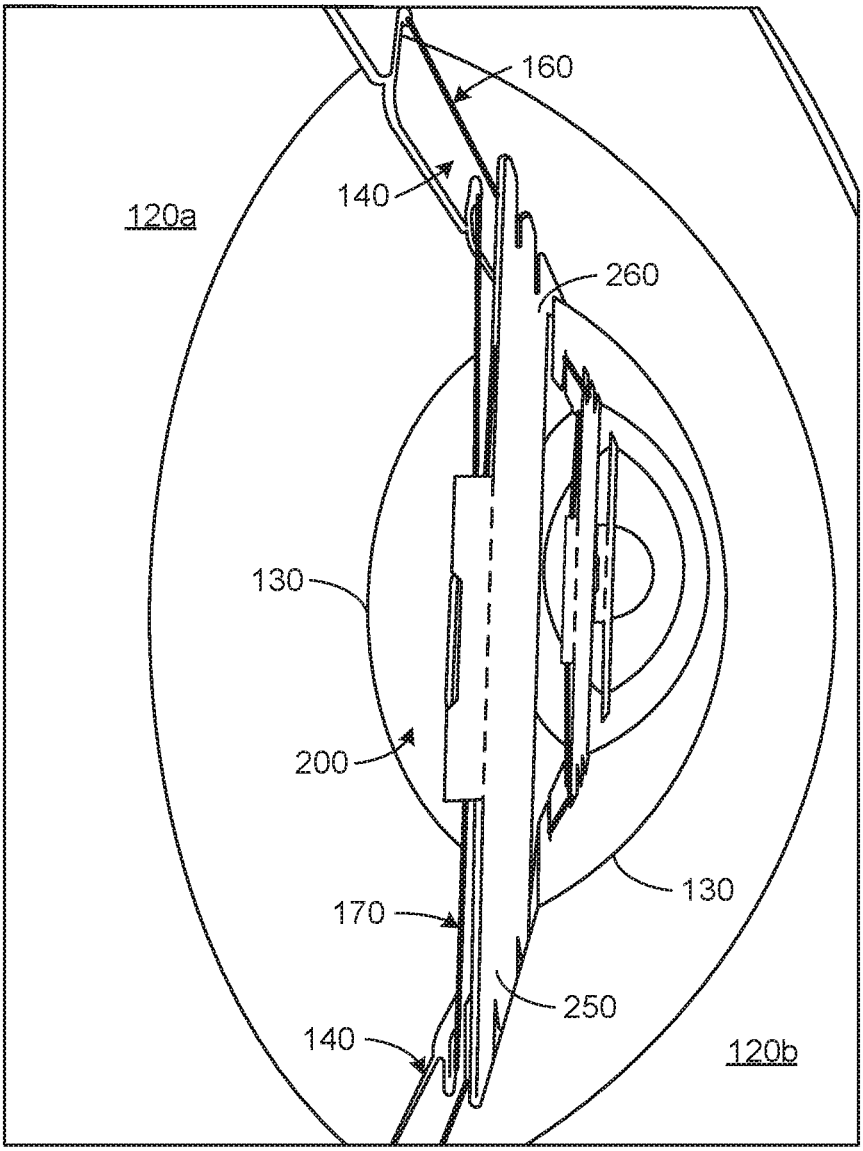
FIG. 8 is an isometric top view of an erected pop-up display in accordance with teachings herein, showing the free-floating stop members or free-floating formers.

FIG. 8 is an isometric top view of an erected pop-up display 100 (see FIG. 2) in accordance with teachings herein, showing a number of free-floating stop members or free-floating formers 200. Substrates 120*a*, 120*b* are connected, as described above, to form the first and second joints 140 to which the elastic members 170 are engaged and to which the free-floating stop members 200 engage in the deployed configuration. During deployment, as the first joint 140 is brought toward a first end (e.g., 250) of the free-floating stop member 200 and the second joint 140 is brought toward the second end (e.g., 260) of the free-floating stop member 200, the first substrate (e.g., 120*a*) and the second substrate (e.g., 120*b*) are biased into a curvilinear shape approaching that of the final deployed state. When the first joint 140 is brought into abutment with a first end (e.g., 250) of the free-floating stop member 200 and the second joint 140 is brought into abutment with the second end (e.g., 260) of the free-floating stop member 200 during deployment, the first substrate (e.g., 120*a*) and the second substrate (e.g., 120*b*) are biased into a final, stable curvilinear shape corresponding to the deployed state (see, e.g., FIG. 2, FIG. 8).

A topmost free-floating stop member 200 corresponding to a topmost segment (e.g., segment 121) of the shroud 120 is shown in the foreground, with a middle free-floating stop member 200 corresponding to a middle segment (e.g., segment 122) and a bottom free-floating stop member 200 corresponding to a bottom segment (e.g., segment 123) in the background.

Figure 9:
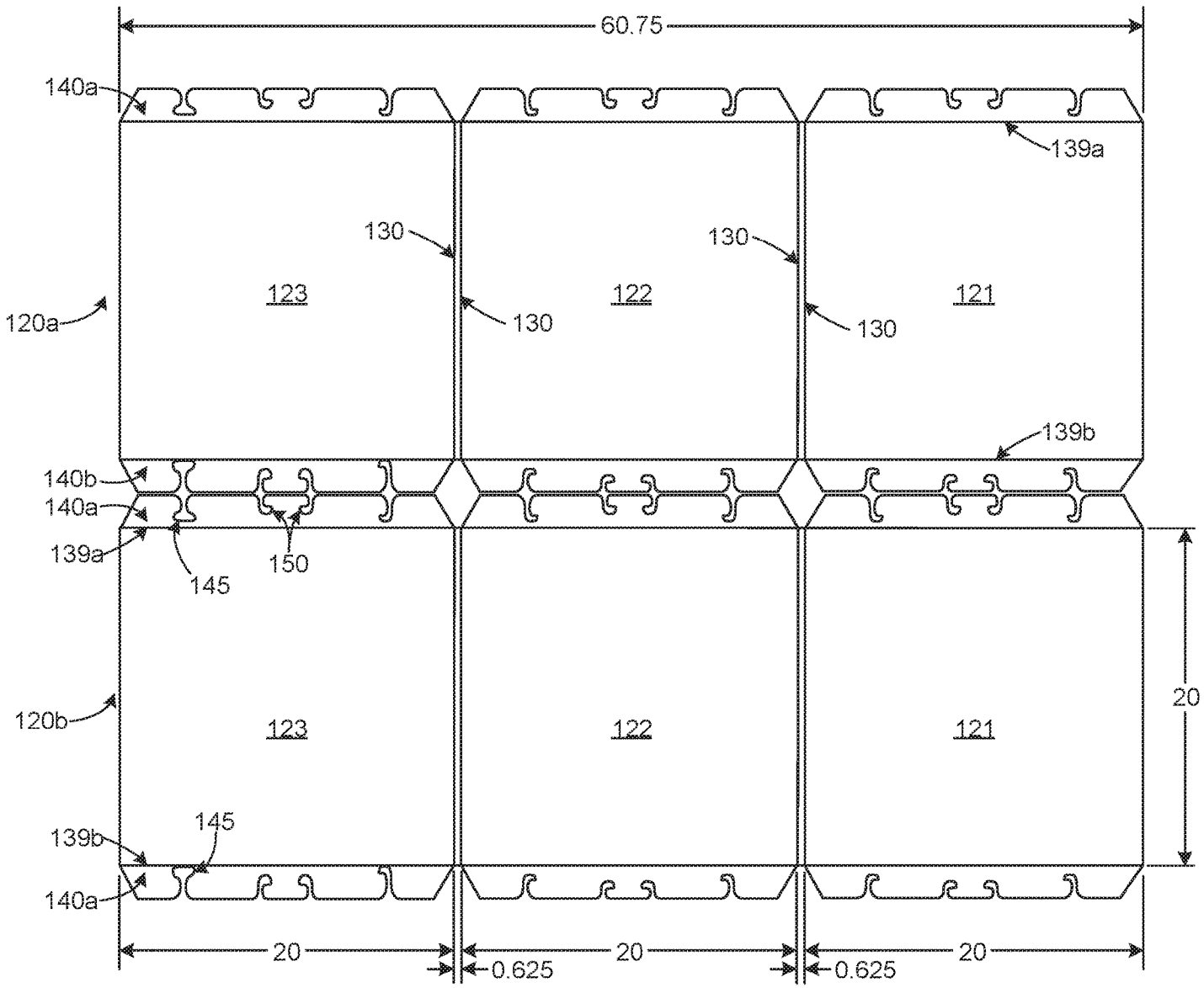
FIG. 9 is a schematic of an example substrate material from which two example substrates of example dimensions are formed in accordance with teachings herein.
Figure 10:
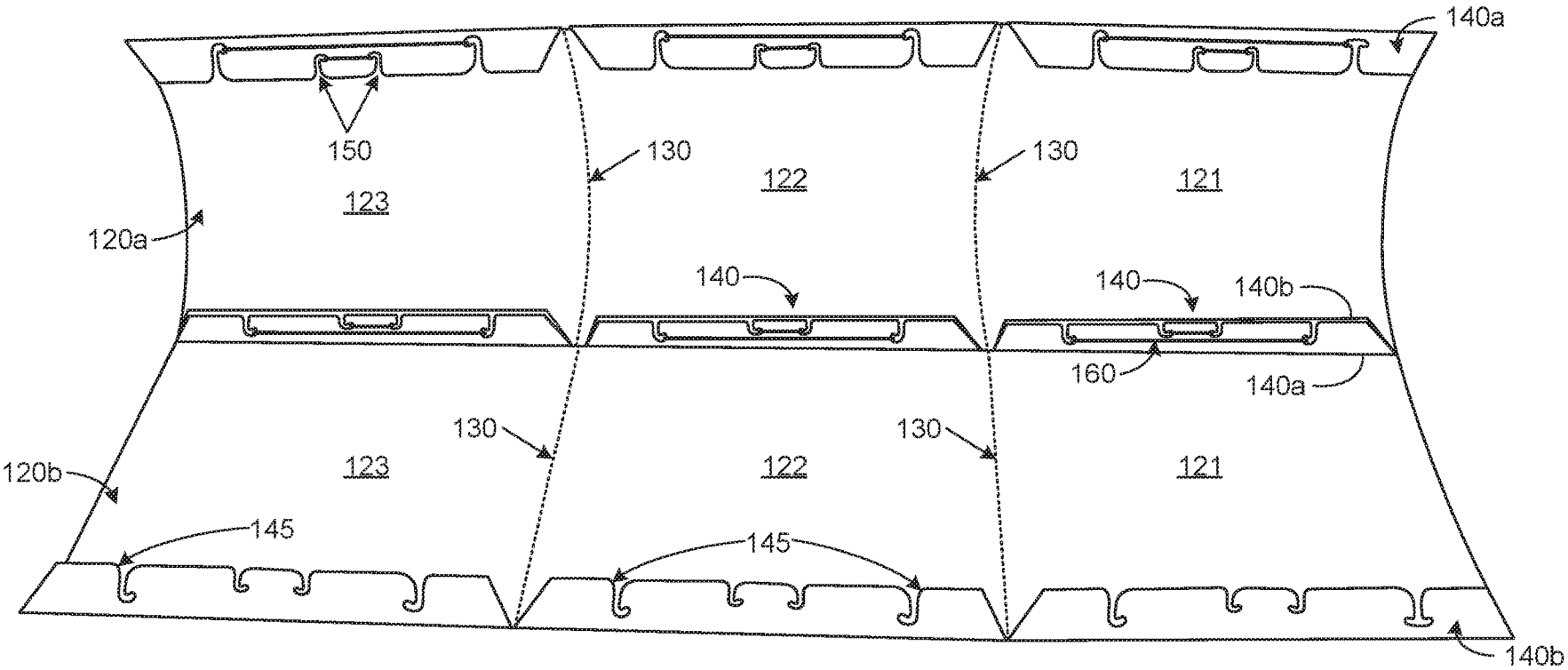
FIG. 10 shows an example of a partially-constructed pop-up display, with two example substrates being connected together in accordance with teachings herein.

FIG. 9 illustrates an example of construction of an example substrate 120*b* for a pop-up display 100 in accordance with teachings herein, whereas FIG. 10 shows an example of an intermediary state of formation of an example pop-up display 100 wherein two substrates 120*a*, 120*b* are connected together along adjacent flaps 140*a*, 140*b* to form a first joint 140.

FIG. 9 shows an example first three-segment substrate 120*a* having a top segment 121, middle segment 122 and bottom segment 123 adjacent to a similarly configured second three-segment substrate 120*b*. Each of the substrates 120*a*, 120*b* has laterally formed flaps 140*a*, 140*b*, each of the flaps 140*a*, 140*b* defining structures including example grooves 145, 150, as described above with respect to FIGS. 3*a*-3*b*. Each of the substrates 120*a*, 120*b* includes a line of weakness 130, or multiple lines of weakness 130 (e.g., parallel lines of weakness separated by a gap, such as ⅜" in the example shown) to permit folding of the display 100. In the example of FIG. 9, the height and width of each segment (e.g., segment 121) is 20"×20" and the overall height of the substrates 120*a*, 120*b* is 60¾" (inclusive of the height of the lines of weakness 130).

FIG. 10 shows a first substrate 120*a* having a first flap 140*a* and a second flap 140*b*, with the second flap 140*b* being placed adjacent to, and being connected to, a first flap 140*a* of a second substrate 120*b*. Each of the substrates 120*a*, 120*b* have substantially similarly configured and situated features (e.g., grooves, lines of weakness, etc.). In an example method of forming a display 100 in accordance with teachings herein, a lateral end of the first substrate 120*a* is placed adjacent to a lateral end of the second substrate 120*b* to place the flaps 140*a*, 140*b* in abutment and the flaps 140*a*, 140*b* are joined to form a first joint 140. In the example shown, the flaps 140*a*, 140*b* are joined to form the first joint 140 using elastic members 160 (see, e.g., FIG. 8). In other examples, the flaps 140*a*, 140*b* are joined by an adhesive or by one or more mechanical connectors.

Figure 11:
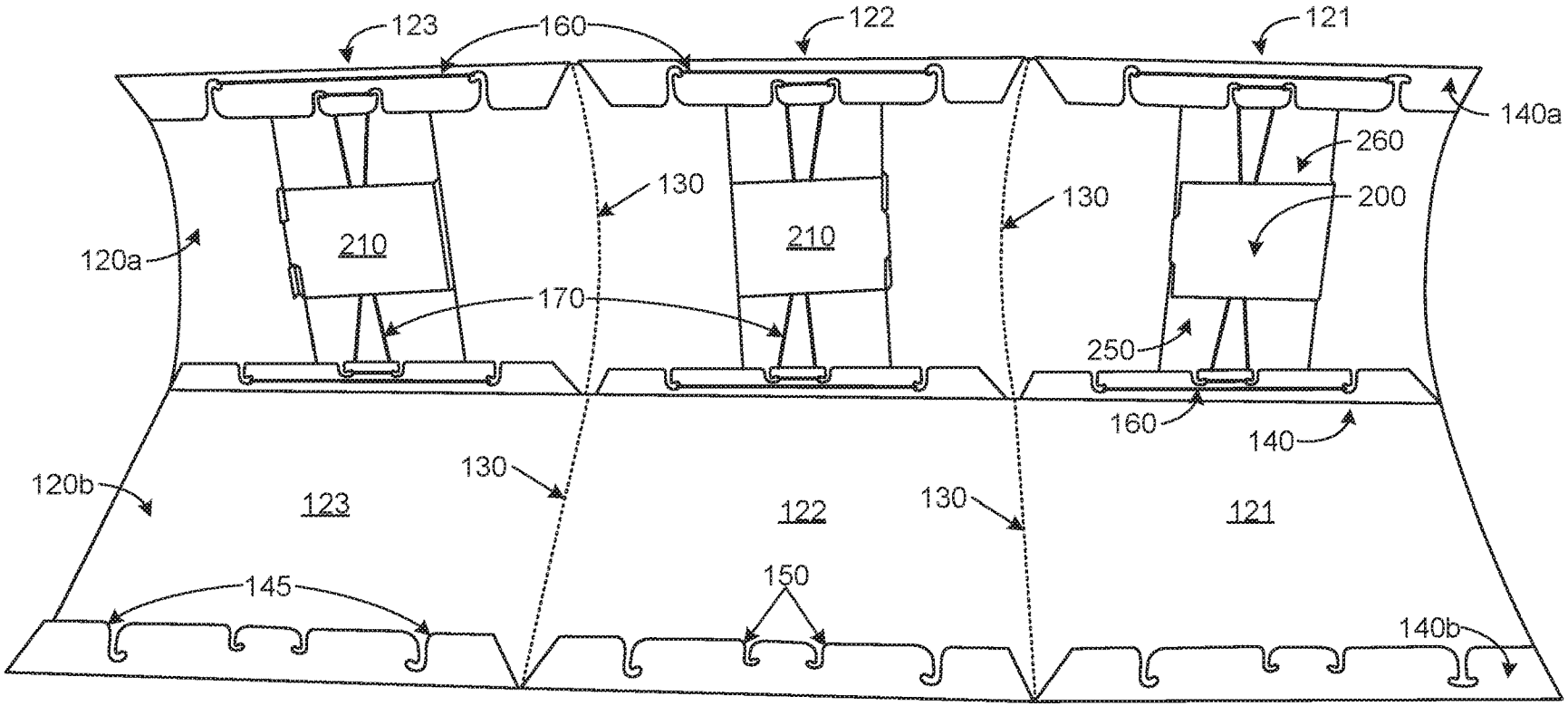
FIG. 11 is another example of a partially-constructed pop-up display, with three example free-floating stop members or free-floating formers substrates being connected together to a joint between both substrates along one end and being connected to substrate at the other end in accordance with teachings herein.

Following the example state of assembly depicted in FIG. 10, a first end portion 250 of each free-floating stop member 200 is placed in the respective segment (e.g., 121, etc.) adjacent the first joint 140 and a second end portion 260 of the free-floating stop member 200 is placed adjacent the "free" flap 140*a*, as is shown in FIG. 11. In each of the segments, a first end of the elastic member 170 is secured to the grooves 150 of the first joint 140, passed through the channel defined by between the free-floating stop member 200 base portion 205 and the retaining member 210, and the second end of the elastic member 170 is optionally connected to the grooves 150 of the "free" flap 140*a* in the manner shown in FIG. 11. Alternatively, the second end of the elastic member 170 is connected to the grooves 150 of the second joint 140 formed after the flaps 140*a*, 140*b* are placed in abutment with one another and/or connected.

From the configuration shown in FIG. 11, substrate 120*a* is then folded over substrate 120*b*, or vice versa, to place the "free" flap 140*a* of substrate 120*a* adjacent the "free" flap 140*b* of substrate 120*b*. In this position, for each segment (e.g., 121-123), the second end of the elastic member 170 is secured about the grooves 150 of the "free" flap 140*b* of substrate 120*b* (and also about the "free" flap 140*a* of substrate 120*a* if not already secured thereto) and the elastic member 160 is secured about the grooves 145 of the "free" flap 140*a* of substrate 120*a* and the "free" flap 140*b* of substrate 120*b*.

FIG. 12 shows an example of a foldable stand 102 that is optionally integrated with the pop-up display of FIGS. 1-11 in accordance with teachings disclosed herein. The foldable stand 102 has a line of weakness 330 bisecting the foldable stand 102 into two halves, which are foldable upon one another. While the example foldable stand 102 has a circular shape, other shapes may be advantageously utilized including, but not limited to, square, rectangular, or polygonal. One or more cutouts, defining retention grooves 310, are formed in the foldable stand 102 symmetrically about the line of weakness 330. In each of the retention grooves 310, a first end of an elastic member 320 is retained. In the unfolded or deployed position, shown in FIG. 12, in which the foldable stand 102 is attached the shroud 120 (e.g., FIG. 2), a second end of the elastic member 320 is then biased toward and secured around, in one example, the lowermost groove 145 in the lowermost segment (e.g., segment 123). In the example shown in FIG. 3*b*, second end of the elastic member 320 is disposed about the bottommost lobe of the two-lobed groove 145.

Figure 13:
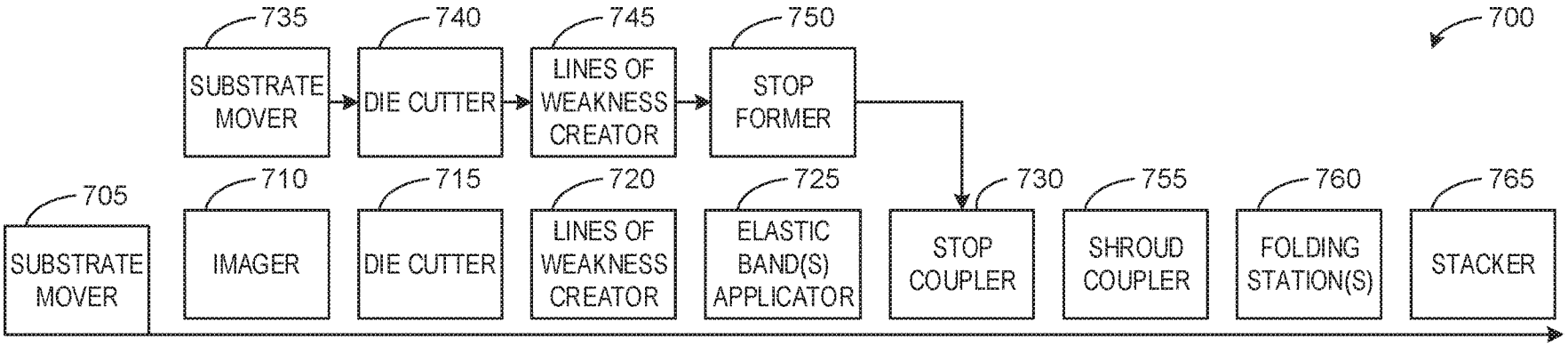
FIG. 13 illustrates an example apparatus that can be used to produce the example pop-up displays disclosed herein.

FIG. 13 represents an example apparatus 700 that can be used to produce the example self-erectable displays 100 disclosed herein. In some examples, the apparatus performs an in-line process that includes processes to produce an example shroud in accordance with the teachings of this disclosure, example processes to produce an example free-floating stop in accordance with the teachings of this disclosure and processes to produce an example self-erectable display 100 in accordance with the teachings of the disclosure. While the processes disclosed below are described in connection with automatic processes, any and/or all of the processes disclosed may instead be implemented manually.

In the illustrated example, the example apparatus 700 includes elements to produce the example shroud and/or the example self-erectable display, including, for example, a first substrate mover 705, an imager 710, a first die cutter 715, a first lines weakness creator 720, an elastic band applicator 725, a free-floating stop member coupler 730, a shroud coupler 755, a folding station 760, and a stacker 765. Feeding into the free-floating stop member coupler 730 is an output (a free-floating stop member 200) formed via a second substrate mover 735, a second die cutter 740, a second lines of weakness creator 745 and a stop former 750.

To produce an example shroud in accordance with the teachings of this disclosure, in some examples, the substrate mover 705 feeds one or more pieces of substrate and/or a web of substrate into the apparatus 700.

In some examples, the imager 710 images a first and/or a second side of the example shroud blank(s) and/or substrate(s) (e.g., 120*a*, 120*b*). The images may include brand-related images and/or text, advertising-related images and/or text, point-of-purchase-related images and/or text, instructional images and/or text, and/or any other desired indicia. The first die cutter 715 forms one or more features and/or notches within the shroud and/or elongate substrates 120*a*, 120*b*, including, for example, first sets of features, grooves and/or notches (e.g., 145) on first and second flaps (e.g., 140*a*, 140*b* of sheet 120*a*) and on third and fourth flaps (e.g., 140*a*, 140*b* of sheet 120*b*) and second sets of features, grooves and/or notches (e.g., 150) on the first and second flaps (e.g., 140*a*, 140*b* of sheet 120*a*) and on the third and fourth flaps (e.g., 140*a*, 140*b* of sheet 120*b*). In some examples, the first sets of grooves 145 receive elastic members 160 that run longitudinally along the first and third flaps 140*a*, 140*b* and longitudinally along the second and fourth flaps 140*a*, 140*b* to couple the first and second elongate substrates 120*a*, 120*b* together. In some examples, the second sets of grooves 150 received elastic members 170 that extend across the interior volume of the self-erectable display 100 to urge the ends or joints 140 of the self-erectable display 100 toward one another. In some examples, the first die cutter 715 form elongate substrates 120*a*, 120*b*, such as the examples illustrated in FIGS. 9, 10 and 11, and, more generally, substrates as disclosed herein. The first lines weakness creator 720 forms one or more lines weakness on the first and/or second sides of the shroud blank and/or the elongate substrates 120*a*, 120*b* using one or more die(s), one or more cutting tool(s), one or more scoring tool(s), one or more slotting tool(s), etc. For example, the first lines of weakness creator 720 may form the lines of weakness 139*a*, 139*b* (see, e.g., FIG. 9) defining the first, second, third and/or fourth flaps 140*a*, 140*b*.

In some examples, to produce an example free-floating stop 200 in accordance with the teachings of this disclosure, the second substrate mover 735 feeds one more pieces of substrate and/or a web of substrate into the apparatus 700. The second die cutter 740 forms one or more free-floating stops 200 from an example web. In some examples, the second die cutter 740 forms substrates such as illustrated in FIG. 4*c*. For example, the second lines weakness creator 745 may form the lines of weakness (e.g., 215*a*-215*d* and 235*a*-235*b*) in the free-floating stop 200 substrate. The second lines weakness creator 745 forms one or more die(s), one or more cutting tool(s), one or more scoring tool(s), one or more slotting tool(s), etc. The stop former forms an example free-floating stop 200, as illustrated in, for example, FIG. 4*a*-4*c* or 6.

In one example, an elastic band applicator 725 couples one or more elastic bands 160 adjacent to one or more flap 140*a*, 140*b* features (e.g., grooves 145, eyelets, etc. defined by the shroud 120 and/or the example elongate substrates 120*a*, 120*b*. In some examples, the elastic band applicator couples one or more elastic bands 160 between the first sets of grooves 145 of the first and third flaps (e.g., 140*a*, 140*b*) and/or between the first sets of grooves 145 of the second flap or the fourth flap (e.g., 140*a*, 140*b*), as shown in FIGS. 3*a*-3*b*.

In some examples, the stop coupler 730 couples an example free-floating stop 200 within the interior of the example shroud 120 by extending an elastic band 170 through the free-floating stop and securing ends of the elastic band 170 to features (e.g., grooves 150) formed in the shroud 120 (e.g., formed in flaps 140*a*, 140*b*).

In some examples, the shroud coupler 755 forms a tubular-shaped shroud 120 by folding the second and fourth flaps (e.g., 140*a*, 140*b*) of a first substrates (e.g., 120*a*) about their respective lines weakness (e.g., 139*a*, 139*b*) and coupling respective pairs of inwardly facing flaps (e.g., 140*a*, 140*b*) on an opposing substrate (e.g., 120*b*) by receiving a fastener (e.g., elastic member 170) within the first sets of features (e.g., grooves 150) of the flaps 140*a*, 140*b* of the substrates 120*a*, 120*b*. The folding station 760 flattens and/or folds the self-erectable display 100 along the longitudinal axes of the shroud 120 and/or folds the self-erectable display about the transverse axes of the shroud, along the line(s) of weakness 130, for storage and/or shipping. The stacker 765 stacks the self-erectable displays 100 for storage and/or shipping, etc. In some examples, the processes implemented by the stop former 750, the elastic band applicator 725, the stop coupler 730, the shroud coupler 755, the folding station 760 and/or the stacker 765 are performed manually.

While the stations and/or portions, including the example first substrate mover 705, the example imager 710, the example first die cutter 715, the example lines of weakness creator 720, the example elastic band applicator 725, the example stop coupler 730, the example shroud coupler 755, the example folding station 760, the example stacker 765, the example second substrate mover 735, the example second die cutter 740, the example second lines of weakness creator 745 and/or the example stop former 750 of the apparatus 700, are depicted in a particular order, the stations and/or portions, including the example first substrate mover 705, the example imager 710, the example first die cutter 715, the example lines of weakness creator 720, the example elastic band applicator 725, the example stop coupler 730, the example shroud coupler 755, the example folding station 760, the example stacker 765, the example second substrate mover 735, the example second die cutter 740, the example second lines of weakness creator 745 and/or the example stop former 750, may be implemented in any other way. For example, the order of the stations and/or portions including the example first substrate mover 705, the example imager 710, the example first die cutter 715, the example lines of weakness creator 720, the example elastic band applicator 725, the example stop coupler 730, the example shroud coupler 755, the example folding station 760, the example stacker 765, the example second substrate mover 735, the example second die cutter 740, the example second lines of weakness creator 745 and/or the example stop former 750 may be changed, and/or some of the example first substrate mover 705, the example imager 710, the example first die cutter 715, the example lines of weakness creator 720, the example elastic band applicator 725, the example stop coupler 730, the example shroud coupler 755, the example folding station 760, the example stacker 765, the example second substrate mover 735, the example second die cutter 740, the example second lines of weakness creator 745 and/or the example stop former 750 may be changed, eliminated, or combined. For example, while the apparatus 700 is depicted as having a first die cutter 715 separate from a first lines of weakness creator 720, in some examples, the die cutter 715 and the lines of weakness creator 720 may be combined.

Figure 14:
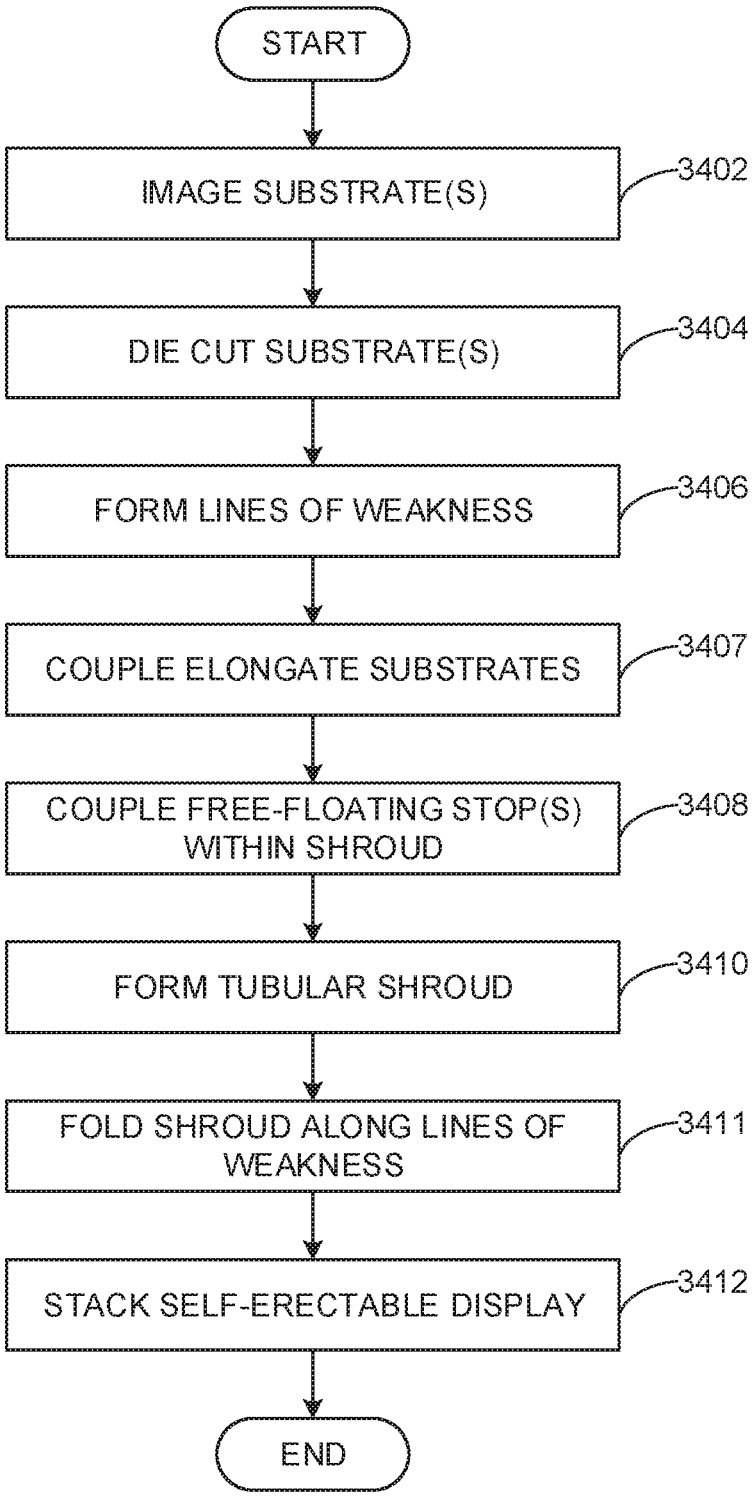
FIG. 14 illustrates a flowchart representative of machine-readable instructions that may be executed to implement the apparatus of FIG. 13.

A flowchart representative of example machine-readable instructions for implementing the apparatus of FIG. 13 is shown in FIG. 14. In this example, the machine-readable instructions comprise a program for execution by a processor such as the processor 3512, shown in the example processor platform 3500 discussed below in connection with FIG. 15. The program may be embodied in software stored on a tangible computer-readable storage medium such as a CD-ROM, a floppy disk, a hard drive, a digital versatile disk (DVD), a Blu-ray disk, or a memory associated with the processor 3512, but the entire program and/or parts thereof could alternatively be executed by a device other than the processor 3512 and/or embodied in firmware or dedicated hardware. Further, although the example program is described with reference to the flowchart illustrated in FIG. 14, many other methods of implementing the example apparatus 700 of FIG. 13 may alternatively be used. For example, the order of execution of the blocks may be changed, and/or some of the blocks described may be changed, eliminated, or combined.

As mentioned above, the example processes of FIG. 14 may be implemented using coded instructions (e.g., computer and/or machine-readable instructions) stored on a tangible computer-readable storage medium such as a hard disk drive, a flash memory, a read-only memory (ROM), a compact disk (CD), a digital versatile disk (DVD), a cache, a random-access memory (RAM) and/or any other storage device or storage disk in which information is stored for any duration (e.g., for extended time periods, permanently, for brief instances, for temporarily buffering, and/or for caching of the information). As used herein, the term "tangible computer-readable storage medium" is expressly defined to include any type of computer-readable storage device and/or storage disk and to exclude propagating signals and transmission media. As used herein, "tangible computer-readable storage medium" and "tangible machine-readable storage medium" are used interchangeably. Additionally or alternatively, the example processes of FIG. 14 may be implemented using coded instructions (e.g., computer and/or machine-readable instructions) stored on a nontransitory computer and/or machine-readable medium such as a hard disk drive, a flash memory, a read-only memory, a compact disk, a digital versatile disk, a cache, a random-access memory and/or any other storage device or storage disk in which information is stored for any duration (e.g., for extended time periods, permanently, for brief instances, for temporarily buffering, and/or for caching of the information). As used herein, the term "nontransitory computer-readable medium" is expressly defined to include any type of computer-readable storage device and/or storage disk and to exclude propagating signals and transmission media. As used herein, when the phrase "at least" is used as the transition term in a preamble of a claim, it is open-ended in the same manner as the term "comprising" is open-ended.

The process of FIG. 14 includes imaging a substrate (e.g., the elongated substrates) (block 3402) using, for example, the imager 710 that images a first and/or second side of the shroud 120 and/or a first and/or a second side of an elongated substrate(s) 120*a*, 120*b* and/or a first and/or a second side of a substrate from which the substrates 120*a*, 120*b* are to be formed with, for example, brand-related images and/or text, advertising-related images and/or text, point-of-purchase-related images and/or text, instructional images and/or other text, indicia and/or images.

The substrate(s) is die cut (block 3404) using, for example, the first die cutter 715 and/or the second die cutter 740 to form the substrates 120*a*, 120*b* and to form features in the substrates 120*a*, 120*b*, such as, but not limited to, the flaps 140*a*, 140*b*, grooves 145 and grooves 150.

Lines of weakness (e.g., 215*a*-215*d* in FIG. 4*c*) are formed (block 3406) in the substrate(s) (e.g., the substrates 120*a*, 120*b*, free-floating stop 200, etc.) using, for example, the first lines of weakness creator 720 and/or second lines of weakness creator 745 that forms one or more lines of weakness, such as described above, on first and/or second sides of the shroud blank and/or first and/or second sides of an elongate substrate(s) and/or on the free-floating stop blank using one or more die(s), one or more cutting tool(s), one or more scoring tool(s), one or more slotting tool(s), etc. and/or line(s) of weakness in the free-floating stop.

The elongate substrates 120*a*, 120*b* are coupled (block 3407), in one example implementation, using an elastic band applicator 725 that couples the first and third flaps (e.g., flaps 140*a*, 140*b* on different substrates 120*a*, 120*b*) and/or the second and fourth flaps (e.g., the other flaps 140*a*, 140*b* on different substrates 120*a*, 120*b*).

In the example presented in FIG. 13, a free-floating stop 200 is coupled within the shroud 120 (block 3408) using, for example, the stop coupler 730 that couples a free-floating stop 200 within the interior of the shroud 120 using elastic members(s) 170. The tubular shroud 120 is formed (block 3410) using, for example, the shroud coupler that folds the shroud 120 about different lines of weakness 130 and couples respective pairs of inwardly facing flaps 140*a*, 140*b* using, for example, elastic members 160 (e.g., rubber bands), adhesive, glue and/or staple(s). In some examples, the shroud coupler 755 couples two elongate substrates together (e.g., 120*a*, 120*b* in FIG. 2). In some examples, the shroud coupler 755 couples side edges of a single substrate together.

The formed self-erectable displays 100 are folded along lines of weakness (e.g., lines of weakness 130 in substrates 120*a*, 120*b*) (block 3412) using, for example, the folding station 760 that flattens and/or folds the self-erectable display 100 about transverse axes of the shroud, such as along lines of weakness 130, for storage and/or shipping. The folded self-erectable displays 100 are stacked (block 3414) using, for example, the stacker 765 that stacks self-erectable displays 100 for storage and/or shipping, etc.

Figure 15:
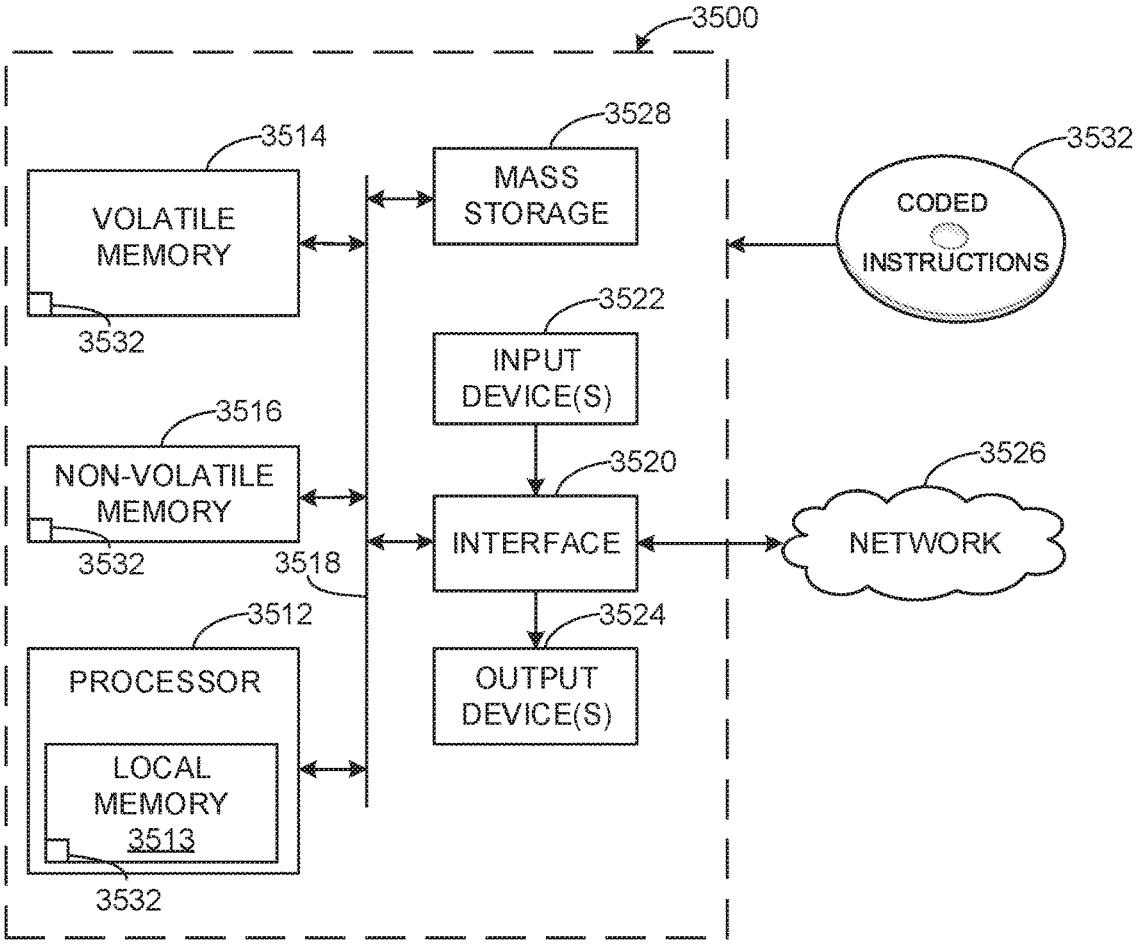
FIG. 15 illustrates a processor platform to execute the instructions of FIG. 14 to implement the apparatus of FIG. 13.

FIG. 15 is a block diagram of an example processor platform 3500 capable of executing the instructions of FIG. 14 to implement the apparatus 700 of FIG. 13. The processor platform 3500 can be, for example, a server, a personal computer, a mobile device (e.g., a tablet such as an iPad™), an Internet appliance, a DVD player, a CD player, a digital video recorder, a Blu-ray player, or any other type of computing device.

The processor platform 3500 of the illustrated example includes a processor 3512. The processor 3512 of the illustrated example is hardware. For example, the processor 3512 can be implemented by one or more integrated circuits, logic circuits, microprocessors or controllers from any desired family or manufacturer.

The processor 3512 of the illustrated example includes a local memory 3513 (e.g., a cache). The processor 3512 of the illustrated example is in communication with a main memory including a volatile memory 3514 and a non-volatile memory 3516 via a bus 3518. The volatile memory 3514 may be implemented by Synchronous Dynamic Random Access Memory (SDRAM), Dynamic Random Access Memory (DRAM), RAMBUS Dynamic Random Access Memory (RDRAM) and/or any other type of random access memory device. The non-volatile memory 3516 may be implemented by flash memory and/or any other desired type of memory device. Access to the main memory 3514, 3516 is controlled by a memory controller.

The processor platform 3500 of the illustrated example also includes an interface circuit 3520. The interface circuit 3520 may be implemented by any type of interface standard, such as an Ethernet interface, a universal serial bus (USB), and/or a PCI express interface.

In the illustrated example, one or more input devices 3522 are connected to the interface circuit 3520. The input device(s) 3522 permit(s) a user to enter data and commands into the processor 3512. The input device(s) can be implemented by, for example, an audio sensor, a microphone, a camera (still or video), a keyboard, a button, a mouse, a touchscreen, a track-pad, a trackball, isopoint and/or a voice recognition system.

One or more output devices 3524 are also connected to the interface circuit 920 of the illustrated example. The output devices 3524 can be implemented, for example, by display devices (e.g., a light emitting diode (LED), an organic light emitting diode (OLED), a liquid crystal display, a cathode ray tube display (CRT), a touchscreen, a tactile output device, a light emitting diode (LED), a printer and/or speakers). The interface circuit 3520 of the illustrated example, thus, typically includes a graphics driver card, a graphics driver chip or a graphics driver processor.

The interface circuit 3520 of the illustrated example also includes a communication device such as a transmitter, a receiver, a transceiver, a modem and/or network interface card to facilitate exchange of data with external machines (e.g., computing devices of any kind) via a network 3526 (e.g., an Ethernet connection, a digital subscriber line (DSL), a telephone line, coaxial cable, a cellular telephone system, etc.).

The processor platform 3500 of the illustrated example also includes one or more mass storage devices 3528 for storing software and/or data. Examples of such mass storage devices 3528 include floppy disk drives, hard drive disks, compact disk drives, Blu-ray disk drives, RAID systems, and digital versatile disk (DVD) drives.

The coded instructions 3532 of FIG. 15 may be stored in the mass storage device 3528, in the volatile memory 3514, in the non-volatile memory 3516, and/or on a removable tangible computer readable storage medium such as a CD or DVD.

Although certain example methods, apparatus and articles of manufacture have been disclosed herein, the scope of coverage of this patent is not limited thereto. On the contrary, this patent covers all methods, apparatus and articles of manufacture fairly falling within the scope of the claims of this patent.

What is claimed is:

1. A pop-up display apparatus, comprising:

a shroud including a first substrate and a second substrate disposed in opposition to one another, the first substrate and the second substrate being connected to one another at a first side by a first joint and at a second side by a second joint;

a free-floating stop member disposed in a volume of the shroud between the first substrate and the second substrate and between the first joint and the second joint, the free-floating stop member including a channel extending along the free-floating stop member for at least a portion of a length of the free-floating stop member; and an elastic member coupling the first joint to the second joint to exert a tensile force therebetween, the elastic member passing through the channel of the free-floating stop member, wherein the disposition of the free-floating stop member allows the free-floating stop member to move vertically within the shroud between a first position and a second position while the pop-up display is erected, and wherein the free-floating stop member is dimensioned to stop inward travel of the first joint and the second joint responsive to the tensile force exerted by the elastic member.

2. The pop-up display apparatus of claim 1, wherein, as the first joint is brought into abutment with a first end of the free-floating stop member and the second joint is brought into abutment with the second end of the free-floating stop member during deployment, the first substrate and the second substrate are biased into a shape corresponding to a deployed state.

3. The pop-up display apparatus of claim 2, wherein the shape corresponding to a deployed state includes one of a triangular, square, diamond, circular, semi-circular, elliptical, polygonal, non-polygonal, curved or elliptical cross-sectional shape.

4. The pop-up display apparatus of claim 1, wherein the first substrate and the second substrate are connected to one another at the first side by a first flap and a second flap, the first flap and the second flap forming the first joint.

5. The pop-up display apparatus of claim 4, wherein the first substrate and the second substrate are connected to one another at the second side by a third flap and a fourth flap, the third flap and the fourth flap forming the second joint.

6. The pop-up display apparatus of claim 1, wherein the shroud includes a plurality of segments separated by lateral lines of weakness formed in the first substrate and the second substrate.

7. The pop-up display apparatus of claim 6, wherein each of the plurality of segments includes a free-floating stop member and a corresponding elastic member.

8. The pop-up display apparatus of claim 1, wherein the free-floating stop member is translatable vertically within a corresponding segment between a first position defined by a top portion of the channel and a second position defined by a bottom portion of the channel.

9. The pop-up display apparatus of claim 1, wherein the channel is defined by a first retaining member portion depending from a first portion of the free-floating stop member and a second retaining member portion depending from a first portion of the free-floating stop member.

10. The pop-up display apparatus of claim 9, wherein the channel has a height less than a height of the free-floating stop member.

11. The pop-up display apparatus of claim 9, wherein at least one of the first retaining member portion and the second retaining member portion includes a locking tab.

12. The pop-up display apparatus of claim 9, wherein at least one of the first retaining member portion defines a male connection element and the second retaining member portion includes a female connection element.

13. The pop-up display apparatus of claim 9, wherein at least one of the first retaining member portion and the second retaining member portion are a cut out from an inner portion of the free-floating stop member, rotatable relative to the free-floating stop member via a line of weakness connecting the cut out to the free-floating stop member.

14. The pop-up display apparatus of claim 1, wherein the elastic member is an elastic band.

15. The pop-up display apparatus of claim 14, wherein the elastic band is connected to the first joint and the second joint so as to cross over itself between the first joint and the second joint.

16. The pop-up display apparatus of claim 1, wherein compressive forces applied to central portions of the first substrate and the second substrate overcome the bias of the elastic element and move the first joint and the second joint away from the free-floating stop member.

17. The pop-up display apparatus, comprising:

a shroud including a first substrate and a second substrate disposed in opposition to one another, the first substrate and the second substrate being connected to one another at a first side by a first joint and at a second side by a second joint;

a free-floating stop member disposed in a volume of the shroud between the first substrate and the second substrate and between the first joint and the second joint, the free-floating stop member including a channel extending along the free-floating stop member for at least a portion of a length of the free-floating stop member; and an elastic member coupling the first joint to the second joint to exert a tensile force therebetween, the elastic member passing through the channel of the free-floating stop member, wherein the free-floating stop member is translatable vertically within the shroud between a first position and a second position, wherein the free-floating stop member is dimensioned to stop inward travel of the first joint and the second joint responsive to the tensile force exerted by the elastic member, and wherein the channel is substantially equal in height to the free-floating stop member.

* * * * *